US009931017B2

(12) United States Patent
Alpert et al.

(10) Patent No.: US 9,931,017 B2
(45) Date of Patent: Apr. 3, 2018

(54) WASHING APPARATUS AND METHOD WITH SPIRAL AIR FLOW FOR DRYING

(75) Inventors: Martin A. Alpert, Beachwood, OH (US); Mark Goodman, Beachwood, OH (US); Charles H. Smoot, Davie, FL (US)

(73) Assignee: Martin A. Alpert, Beachwood, OH (US)

( * ) Notice: Subject to any disclaimer, the term of this patent is extended or adjusted under 35 U.S.C. 154(b) by 98 days.

(21) Appl. No.: 13/885,227

(22) PCT Filed: Nov. 16, 2011

(86) PCT No.: PCT/US2011/061051

§ 371 (c)(1),
(2), (4) Date: May 14, 2013

(87) PCT Pub. No.: WO2012/068291

PCT Pub. Date: May 24, 2012

(65) Prior Publication Data

US 2013/0233355 A1 Sep. 12, 2013

Related U.S. Application Data

(60) Provisional application No. 61/510,908, filed on Jul. 22, 2011, provisional application No. 61/479,394,
(Continued)

(51) Int. Cl.
*A47L 15/48* (2006.01)
*A47K 10/48* (2006.01)
(Continued)

(52) U.S. Cl.
CPC ..... *A47L 15/48* (2013.01); *A47K 10/48* (2013.01); *A47L 15/0089* (2013.01);
(Continued)

(58) Field of Classification Search
None
See application file for complete search history.

(56) References Cited

U.S. PATENT DOCUMENTS 1,798,428 A 3/1931 Lindgren
1,907,152 A 5/1933 Fielding
(Continued)

FOREIGN PATENT DOCUMENTS

CH 497 890 10/1970
CN 2208896 10/1995
(Continued)

OTHER PUBLICATIONS http://www.neatorama.com/2010/04/04/this-is-not-a-spiral/.*
(Continued)

*Primary Examiner* — Michael Kornakov
*Assistant Examiner* — Pradhuman Parihar
(74) *Attorney, Agent, or Firm* — Renner, Otto, Boisselle & Sklar, LLP.

(57) ABSTRACT

An apparatus and method for washing and drying objects includes a rotating washing fluid sprayer having several nozzles to direct washing fluid, e.g., water, at an object being washed in a chamber. A drying fluid is directed at the object in the chamber to dry the object. The drying fluid, e.g., air, is directed in a spiral pattern against the object to urge washing liquid away from the object to dry the object and to push the drying liquid away from edges of the object. The air may be directed at the object simultaneously with the water to increase the energy with which the water impinges on the object and to urge dirt from the object being washed.

30 Claims, 22 Drawing Sheets

Related U.S. Application Data filed on Apr. 26, 2011, provisional application No. 61/414,421, filed on Nov. 16, 2010.

(51) Int. Cl.

| | |
|---|---|
| ***A47L 15/00*** | (2006.01) |
| ***A47L 15/42*** | (2006.01) |
| ***B08B 3/02*** | (2006.01) |
| ***B08B 5/02*** | (2006.01) |

(52) U.S. Cl.

CPC ..... *A47L 15/4242* (2013.01); *A47L 15/486* (2013.01); *B08B 3/024* (2013.01); *B08B 5/02* (2013.01); *A47K 2210/00* (2013.01)

(56) References Cited

U.S. PATENT DOCUMENTS

| | | | | |
|---|---|---|---|---|
| 1,934,539 | A | 11/1933 | Henderson | |
| 2,277,291 | A | 3/1942 | Blair | |
| 2,418,691 | A | 4/1947 | Bjering et al. | |
| 2,532,925 | A | 12/1950 | Loeb | |
| 2,651,065 | A | 9/1953 | O'Connor | |
| 3,072,128 | A | 1/1963 | Duane | |
| 3,656,491 | A | 4/1972 | Ballard | |
| 3,663,979 | A | 5/1972 | Shaw | |
| 3,800,813 | A | 4/1974 | Noren | |
| 3,849,900 | A * | 11/1974 | Dale et al. | 34/368 |
| 3,915,180 | A | 10/1975 | Jacobs | |
| 4,135,531 | A | 1/1979 | Federighi et al. | |
| 4,164,197 | A * | 8/1979 | Nelson | 116/227 |
| 4,174,722 | A | 11/1979 | Fleenor et al. | |
| 4,223,418 | A | 9/1980 | Pedrini et al. | |
| 4,231,806 | A | 11/1980 | Henry | |
| 4,235,642 | A | 11/1980 | Federighi et al. | |
| 4,285,352 | A | 8/1981 | McMahon et al. | |
| 4,366,005 | A | 12/1982 | Oguri et al. | |
| 4,561,144 | A | 12/1985 | Marais et al. | |
| 4,683,009 | A | 7/1987 | Shriver | |
| 5,123,207 | A * | 6/1992 | Gillis, Jr. | B24C 1/003 451/89 |
| 5,267,580 | A | 12/1993 | Payzant | |
| 5,449,011 | A | 9/1995 | Jacobus et al. | |
| 5,470,142 | A | 11/1995 | Sargeant et al. | |
| 5,581,836 | A | 12/1996 | Kleber et al. | |
| 5,619,767 | A | 4/1997 | Larson | |
| 5,687,752 | A | 11/1997 | Boylan | |
| 5,846,373 | A * | 12/1998 | Pirkle | C23C 16/4405 156/345.25 |
| 5,924,148 | A | 1/1999 | Flowers, Sr. | |
| 5,875,800 | A | 3/1999 | Hulskotte | |
| 5,882,739 | A | 3/1999 | Kobes et al. | |
| 5,997,653 | A * | 12/1999 | Yamasaka | B08B 3/02 134/102.1 |
| 6,092,540 | A | 7/2000 | Chiao et al. | |
| 6,422,180 | B1 | 7/2002 | Yiu | |
| 6,578,586 | B2 | 6/2003 | Moh | |
| 6,705,330 | B1 | 3/2004 | Favret | |
| 7,596,886 | B1 * | 10/2009 | Boyd | B08B 17/00 134/148 |
| 7,604,012 | B2 | 10/2009 | Alpert et al. | |
| 2002/0037367 | A1 * | 3/2002 | Ema et al. | 427/240 |
| 2002/0153021 | A1 | 10/2002 | Audet | |
| 2003/0024554 | A1 | 2/2003 | Schultz et al. | |
| 2004/0060573 | A1 * | 4/2004 | Woods | C25D 5/22 134/1.3 |
| 2005/0072449 | A1 * | 4/2005 | Alpert et al. | 134/25.1 |
| 2005/0150451 | A1 * | 7/2005 | Tanaka | H01L 21/6715 118/688 |
| 2006/0068110 | A1 * | 3/2006 | Fukuda | H01L 21/6708 427/256 |
| 2006/0254073 | A1 * | 11/2006 | Zhen | 34/96 |
| 2007/0105057 | A1 * | 5/2007 | Hwang | G03F 7/095 430/322 |
| 2007/0160772 | A1 * | 7/2007 | Morimoto | H01L 51/0005 427/466 |
| 2009/0077825 | A1 * | 3/2009 | Toofan | H01L 21/67034 34/273 |
| 2009/0202951 | A1 * | 8/2009 | Yamamoto | G03F 7/168 430/322 |
| 2009/0205680 | A1 * | 8/2009 | Bragg | 134/18 |
| 2009/0308413 | A1 * | 12/2009 | Freer | B08B 3/003 134/21 |

FOREIGN PATENT DOCUMENTS

| | | | |
|---|---|---|---|
| DE | 42 16 229 | | 11/1993 |
| DE | 19618770 | A1 | 11/1997 |
| DE | 20305082 | U1 | 6/2003 |
| EP | 0650692 | A1 | 5/1995 |
| EP | 0688607 | A1 | 12/1995 |
| EP | 1281347 | A1 | 2/2003 |
| FR | 1 057 621 | | 3/1954 |
| FR | 1 354 097 | | 2/1964 |
| FR | 1 439 607 | | 5/1966 |
| FR | 1 486 181 | | 6/1967 |
| FR | 2 232 291 | | 1/1975 |
| FR | 2272023 | A | 1/1976 |
| FR | 2 784 886 | | 4/2000 |
| FR | 2 846 865 | | 5/2004 |
| GB | 628164 | | 8/1949 |
| GB | 687 379 | | 2/1953 |
| GB | 2 148 702 | | 6/1985 |
| JP | 01022233 | | 1/1989 |
| JP | 03039134 | | 2/1991 |
| JP | 06197857 | | 7/1994 |
| JP | 07150864 | | 6/1995 |
| JP | 07-327909 | | 12/1995 |
| JP | 08-256926 | | 10/1996 |
| JP | 08-323305 | | 12/1996 |
| JP | 09108160 | | 4/1997 |
| JP | 10-066940 | | 3/1998 |
| JP | 10258013 | | 9/1998 |
| JP | 11021962 | | 1/1999 |
| JP | 2000-139803 | | 5/2000 |
| JP | 2002-051962 | | 2/2002 |
| JP | 2002-065564 | | 3/2002 |
| JP | 2002065548 | | 3/2002 |
| JP | 2002-336177 | | 11/2002 |
| JP | 2002-360494 | | 12/2002 |
| JP | 2003061766 | | 3/2003 |
| JP | 2003235778 | | 8/2003 |
| KR | 2005006518 | A | 1/2005 |
| WO | WO 03055373 | A1 | 7/2003 |
| WO | WO 2005 018407 | | 3/2005 |
| WO | WO 2012068291 | | 5/2012 |

OTHER PUBLICATIONS http://mathworld.wolfram.com/ConcentricCircles.html.*

International Search Report, corresponding to PCT/US2011/061051 dated Mar. 26, 2012.

International Preliminary Report on Patentability, corresponding to PCT/US2011/061051 dated Nov. 23, 2012.

International Search Report for International Application No. PCT/US 2004/027794, dated Sep. 20, 2005.

Written Opinion for International Application No. PCT/US 2004/027794, dated Sep. 20, 2005.

* cited by examiner

WASHING APPARATUS AND METHOD WITH SPIRAL AIR FLOW FOR DRYING

CROSS-REFERENCE TO RELATED APPLICATION

This application claims the benefit of U.S. Provisional Patent Application Ser. No. 61/414,421, filed Nov. 16, 2010, 61/479,394, filed Apr. 26, 2011, and 61/510,908, filed Jul. 22, 2011, the entire disclosures of which are hereby incorporated by reference.

Priority of Ser. No. 61/414,421, filed Nov. 16, 2010 is claimed, and the entire disclosure thereof hereby is incorporated by reference.

Priority of Ser. No. 61/479,394, filed Apr. 26, 2011 is claimed, and the entire disclosure thereof hereby is incorporated by reference.

TECHNICAL FIELD

This invention relates generally to apparatus and method for washing a dish or other object or one or more hands of a person and for drying a wet object, e.g. a washed dish, other object or hand(s) using air flow in a generally spiral pattern impinging on the dish, object or hand(s). This invention also relates to a dish washer with both washing and drying functions for washing and drying one dish at a time. Further this invention relates to apparatus and method that provides for both washing and drying of one or both hands of a person.

BACKGROUND

When using a conventional dishwasher, typically a person would load many dishes at a time, start a washing and drying cycle, and eventually remove the dishes from the dishwasher. A substantial period of time, e.g., on the order of one hour, typically is needed for a complete cycle of operation of a conventional dishwasher. A problem with conventional dishwashers and using them is that a user would have to wait that substantial period until the dish(es) are cleaned and ready for further use or storage and sometimes the dishes are not completely dry after the dishwasher has completed operation, and, therefore, a user would have to use a towel to complete drying.

U.S. Pat. No. 7,604,012, which is incorporated in its entirety by this reference, discloses a dishwasher including embodiments for washing one dish at a time, and the process takes only a short time per dish, e.g., on the order of seconds, not minutes. Therefore, for example, when entertaining a large number of guests, e.g., ten or twelve persons, at a dinner party, dishes used for salad quickly could be washed, one at a time, and re-used for dessert. Alternatively or additionally, after dinner all the dishes used for dinner could be efficiently washed, one at a time, and placed away without having to load a dishwasher with all the dishes, to wait for the dishwasher to work for about an hour, and then to unload and store the clean dishes.

SUMMARY

A problem with many devices for drying dishes in a dishwasher is that water tends to adhere to the surface, to the perimeter edge and/or to a raised or recessed surface relative to the major surface of a dish that has been washed and, therefore, it is difficult to dry the dish. For example, after a dish that has been washed in a conventional dishwasher is removed from the dishwashing chamber some moisture may be found around the perimeter of the dish; a user then may complete the drying of the dish using a towel prior to placing the dish in a cabinet for storage or on a table for use.

Briefly, an aspect of the invention relates to an apparatus and method for washing objects by directing washing fluid at the object and directing drying fluid at the object directing the drying fluid at the object such that the pattern of the drying fluid is spiral. The pattern may be other than spiral but is such that it pushes liquid off edges or perimeter areas of the object being washed. These features of the apparatus and method are utilized in a dishwasher of a size, shape and configuration to wash and dry one dish, glass, bowl, pot or the like at a time. These features of the apparatus and method also may be utilized to wash one or both hands of a person such that the person inserts one or both hands in the apparatus, and the hand(s) is(are) washed and dried without having to remove the hands from the apparatus.

An aspect of the invention relates to a washing and drying apparatus, including a housing, a chamber in the housing, a washing fluid dispenser configured to direct a spray of wash fluid to an object in the chamber to wash the object, and a drying fluid dispenser configured to direct a flow of drying fluid at an object in the chamber to dry the object, wherein the drying fluid dispenser directs a flow of drying fluid in a spiral pattern as the drying fluid is directed toward the object.

According to another aspect the drying fluid dispenser comprises a pair of relatively rotating discs, one having at least one elongate, slot therethrough and the other having at least one curved slot therethrough, wherein the pair of rotating discs are aligned in sequential flow relation to each other such that drying fluid provided the apparatus first flows through one of the slots and subsequently flows through the other of the slots, and wherein in response to the discs rotating at different speeds of rotation the slots are configured to direct the flow of drying fluid in the chamber toward an object to be dried in a spiral pattern against a surface of such object.

According to another aspect, one disc includes a support for at least one nozzle to spray washing fluid toward an object in the chamber, an annular recess about the disc to receive washing fluid therein from a source, and a flow path from the annular recess to the at least one nozzle.

According to another aspect, included is a source of washing fluid coupled in generally fluidically sealed relation with the annular recess, whereby while the one disc rotates washing fluid is supplied to the annular recess for coupling via the flow path to the at least one nozzle.

According to another aspect, included is an air handler or a blower to direct or to blow air as drying fluid to the fluid dispenser.

According to another aspect, included is a motor configured to rotate the discs at different respective speeds of rotation.

According to another aspect, the slot through one disc is generally straight and the slot through the other disc is generally of spiral shape.

According to another aspect, included is a holder configured to hold an object to be washed in the chamber.

According to another aspect, included are openings for placing one or more hands of a person into the chamber for washing and drying of the hands.

According to another aspect, included is a source of wash fluid for delivery to the washing fluid dispenser to wash an object in the chamber.

According to another aspect, included are a drain configured to drain liquid from the chamber and a monitor configured to examine liquid draining from the chamber to provide information indicative of the extent of cleanliness of an object being washed.

According to another aspect, included are a lift mechanism to receive an object in the chamber to lower the object into the chamber for washing and drying of the object and for lifting the object for convenient removal of the object.

According to another aspect, included is a dispenser of detergent and/or sanitizer into the chamber.

According to another aspect, included is a source of ultraviolet light providing ultraviolet light in the chamber.

According to another aspect, at least part of the chamber is transmissive of light to permit viewing inside the chamber while an object is being washed and/or dried.

According to another aspect, that part of the chamber that is transmissive of light is non-transmissive of ultraviolet light.

According to another aspect, included are controls configured to control the flow of washing fluid and drying fluid to wash and dry an object in the chamber.

According to another aspect, the washing fluid dispenser and drying fluid dispenser are configured to wash an object in the chamber while simultaneously directing both washing fluid and drying fluid to the object during washing thereof.

Another aspect relates to a method of washing and drying, comprising directing a flow of washing fluid at an object in a chamber to wash the object and directing a flow of drying fluid at the object in a spiral pattern.

According to another aspect, the method includes directing the flow of drying fluid at the object both while the object is being washed by washing fluid and while the object is being dried while washing fluid is not directed at the object.

An aspect of the present invention is to dry a wet object, such as a dish, for example, or a beverage device, e.g., a drinking glass, coffee cup or the like, by directing an air flow or flow of other gaseous drying fluid against a wet object such that the pattern of the impinging flow is generally in a spiral pattern.

Another aspect relates to a dishwasher comprising a fluid dispenser for washing a dish in a washing chamber, a source of water and a source of air, and a dispenser for directing fluid including both water and air to was a dish in the washing chamber.

According to another aspect, the dishwasher includes a plenum or reservoir containing a liquid for washing a dish, and a flow path coupled to receive air and to direct the air into the plenum or reservoir for use with the water to wash a dish.

According to another aspect, the dishwasher includes a nozzle for directing a combination of air and water in the washing chamber to wash a dish therein.

According to another aspect, the dishwasher includes a drier for directing air to a dish in the washing chamber to dry the dish.

According to another aspect, the dishwasher includes a combination nozzle to control the flow of fluid to wash a dish and to dry the dish in the washing chamber, wherein the same nozzle is used to direct washing fluid and drying air to the washing chamber respectively to wash and to dry a dish.

According to another aspect, the washing fluid is a combination of air and water.

According to another aspect, the mix of water and air directed to the washing chamber to wash a dish has increased energy compared to only washing with water.

According to another aspect, the dishwasher is of a size and shape to contain one dish at a time for washing and drying of the dish.

According to another aspect, the dishwasher includes a control configured to control the flow of fluid to the washing chamber to wash and to dry a dish therein.

According to another aspect, the dishwasher includes a valve control configured to control the shape and size of the nozzle through which air and water are directed to a dish in the washing chamber for washing the dish and through which air is directed to the dish for drying the dish.

According to another aspect, a method of washing a dish includes directing a flow of water and air toward a dish to wash the dish.

According to another aspect, the method includes directing a flow of air toward a dish to dry the dish.

According to another aspect, the method includes directing of the combination of air and water to wash a dish and for directing air to dry the dish comprises delivering the fluid through the same nozzle.

According to another aspect, the method includes directing of the combination of air and water to wash a dish and for directing air to dry the dish comprises delivering the fluid through different nozzles.

Another aspect relates to a dishwasher in which a spiral flow of air is used for drying one dish at a time that is in the dishwasher.

Another aspect relates to a fluid dispenser, including a rotatable support, a fluid outlet movably mounted with respect to the support and configured to permit fluid flow out from the fluid outlet, wherein the fluid outlet is movable with the support during rotation of the support and is movable with respect to the support during rotation of the support to tend to direct fluid out from the fluid outlet in a generally spiral path or pattern.

According to another aspect, the dispenser is a dishwasher or is part of a dishwasher for washing one dish at a time.

According to another aspect, the support includes a generally circular surface.

According to another aspect, the dispenser includes a plenum and wherein the support includes a wall of the plenum.

According to another aspect, a space faces the support and fluid outlet, and wherein the fluid outlet and support are cooperatively configured to direct a generally spiral flow of fluid into the space.

According to another aspect, a motive device is configured to move the fluid outlet generally in a linear path along a direction generally in parallel with a surface of the support.

According to another aspect, the motive device is configured to move the fluid outlet in a reciprocating motion.

According to another aspect, a motor is configured to rotate the rotatable support.

According to another aspect, the motor is an electric motor.

According to another aspect, the motor is a fluid motor.

According to another aspect, the motor is configured to reciprocate the support rotating it generally about its axis in opposite directions.

According to another aspect, the fluid outlet includes a hose or tube.

According to another aspect, a fluid source is coupled to deliver fluid to the fluid outlet.

According to another aspect, the fluid is a gas.

According to another aspect, the fluid is air.

According to another aspect, a holder holds an object to be dried, and the fluid outlet is directed toward the area of an object held by the holder to provide fluid in against such object in a generally spiral path in a manner tending to dry a wet object.

According to another aspect, liquid outlets are configured to spray a liquid against an object.

According to another aspect, the fluid outlet and support are configured to direct a flow of gas toward such object in a manner to dry the object.

According to another aspect, the liquid is water to wash the object and the outlet is configured to direct a flow of air to dry the object.

According to another aspect the support includes a plenum or reservoir containing a liquid to wash an object, and spray nozzles are coupled to receive liquid from the plenum or reservoir to spray an object for washing.

According to another aspect, the support is rotatable about an axis and the nozzles rotate on respective axes that are relatively fixed with respect to the support and the outlet is movable in a direction generally parallel with a surface of the support.

According to another aspect, a control is configured to control flow of liquid from the nozzles for washing an object, to stop the flow of liquid, and to commence the flow of fluid from the fluid outlet to dry the washed object.

According to another aspect, a housing or casing contains the support and fluid outlet.

According to another aspect, a source of ultraviolet radiation is configured to provide ultraviolet radiation in the housing or casing for disinfecting.

According to another aspect, a source of detergent is provided to dispense detergent for washing an object exposed to the dispenser.

According to another aspect, a drive is configured to move the support and the fluid outlet in respective reciprocating paths.

According to another aspect, a slot is in the support, and the outlet is movable along the slot to deliver output fluid in a generally spiral pattern as the outlet is moved along the slot while the support is rotating.

According to another aspect, a connection is provided to a source of water for washing an object.

According to another aspect, a blower is configured to supply a source of air flow for distribution out from the fluid outlet.

According to another aspect, a dishwasher includes a housing, the dispenser of any one or more of the above features of dispenser in the housing, an entrance for placing one dish at a time into the housing in exposure to be washed and dried by the dispenser.

According to another aspect, a support is configured to hold a dish in position relative to the dispenser for washing and drying of the dish.

According to another aspect the support includes a lifting jack configured to lower one dish at a time into the housing in position to be washed and dried by the dispenser and to lift the dish to the entrance for removal of the dish.

According to another aspect, there are two dispensers arranged on opposite sides of a housing in the dishwashing chamber thereof to wash both sides of a dish at the same time and then to dry both sides of the dish at the same time.

According to another aspect, a fluid dispenser for washing and drying objects, e.g., dishes, hands of a person, and so on, includes a fluid outlet, a rotatable support, a slot in the rotatable support, the fluid outlet being movable in the slot while the rotatable support rotates, whereby the fluid outlet traverses a spiral path as it moves along the slot while the support rotates.

According to another aspect, the support can rotate continuously or back and forth (reciprocally) clockwise/counterclockwise.

According to another aspect, the fluid outlet can move back and forth in the slot.

According to another aspect, the fluid from the fluid outlet is provided in a spiral impinging pattern.

According to another aspect, an extensible hose is coupled to supply fluid to the fluid outlet.

According to another aspect, the fluid is air.

According to another aspect, the fluid outlet slides in the slot.

According to another aspect, a mounting structure movably mounts the fluid outlet relative to the support.

According to another aspect the support is a plenum containing washing fluid.

According to another aspect, the washing fluid is water.

According to another aspect, nozzles are fluidically coupled to receive fluid from the plenum and rotatable with the support; and the nozzles rotate with the rotation of the support.

According to another aspect, a control controllably sequences distributing of air and water from respective fluid outlet and nozzles.

According to another aspect, a dispenser is provided for dispensing soap or other cleaning agent and/or disinfecting agent.

According to another aspect, the soap, cleaning agent or disinfecting agent is a liquid.

According to another aspect, a dishwasher includes the dispenser of any one or more of the above aspects.

According to another aspect, a dishwasher housing contains at least part of the dispenser, and a wash area is in the housing where a dish may be washed by washing fluid from nozzles and dried by air from the fluid outlet that is provided in a spiral pattern against a surface of the dish.

According to another aspect, an entrance into the wash area in the housing is configured to restrict entry into the dishwasher so that the dish washer can receive only one dish at a time for washing and drying.

Another aspect relates to a method of washing and drying a dish including directing washing fluid against a surface of a dish, and directing a flow of gas at the dish to impinge on a surface of the dish in a generally spiral pattern.

Another aspect relates to restricting washing and drying to only one dish at a time.

Another aspect relates to placing only one dish at a time into a dishwasher housing, wherein the entrance to the dishwasher housing is configured to restrict passage of only one dish at a time to ether the housing.

Another aspect relates to using a spiral pattern of air to dry a dish.

Another aspect relates to a dishwasher including a housing having a dishwashing chamber, a pair of fluid dispensers to wash and dry a single dish placed in the dishwasher, and dispensers at two sides of the dishwashing chamber do dispense washing fluid and drying fluid, e.g., air, to respective sides of a dish, including a rotatable support, a fluid outlet movably mounted with respect to the support and configured to permit fluid flow out from the fluid outlet, and wherein the fluid outlet is movable with the support during rotation of the support and is movable with respect to the support during rotation of the support to tend to direct fluid out from the fluid outlet in a generally spiral path or pattern to dry a dish in the dishwashing chamber.

One or more of the above and other aspects, objects, features and advantages of the present invention are accomplished using the invention described and claimed below. Also it will be appreciated that a part or feature, etc. shown in one embodiment or drawing may be used in the same or a similar way in another embodiment.

These and further aspects and features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the appended claims.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed.

Although the invention is shown and described with respect to certain embodiments, it is obvious that equivalents and modifications will occur to others skilled in the art upon the reading and understanding of the specification. The present invention includes all such equivalents and modifications, and is limited only by the scope of the claims.

BRIEF DESCRIPTION OF THE DRAWINGS

The annexed drawings are not necessarily to scale and may be somewhat schematic. Directions are shown for convenience of illustration and description but may not necessarily be limiting to the direction of orientation and operation of respective parts. Reference numerals with a prime indication, e.g., 1', may be used to designate parts that are similar in structure and function or are equivalent to a corresponding part designated by an unprimed reference numeral.

In the annexed drawings,

FIG. 20 is a schematic illustration of a hand washing and drying device that is similar to two dishwashers side by side, but without a basket for dishes and configured for placement of respective hands of a person into respective washing chambers for washing with liquid and drying without the need to touch any faucets or dryer switches or the like.

Figure 1:
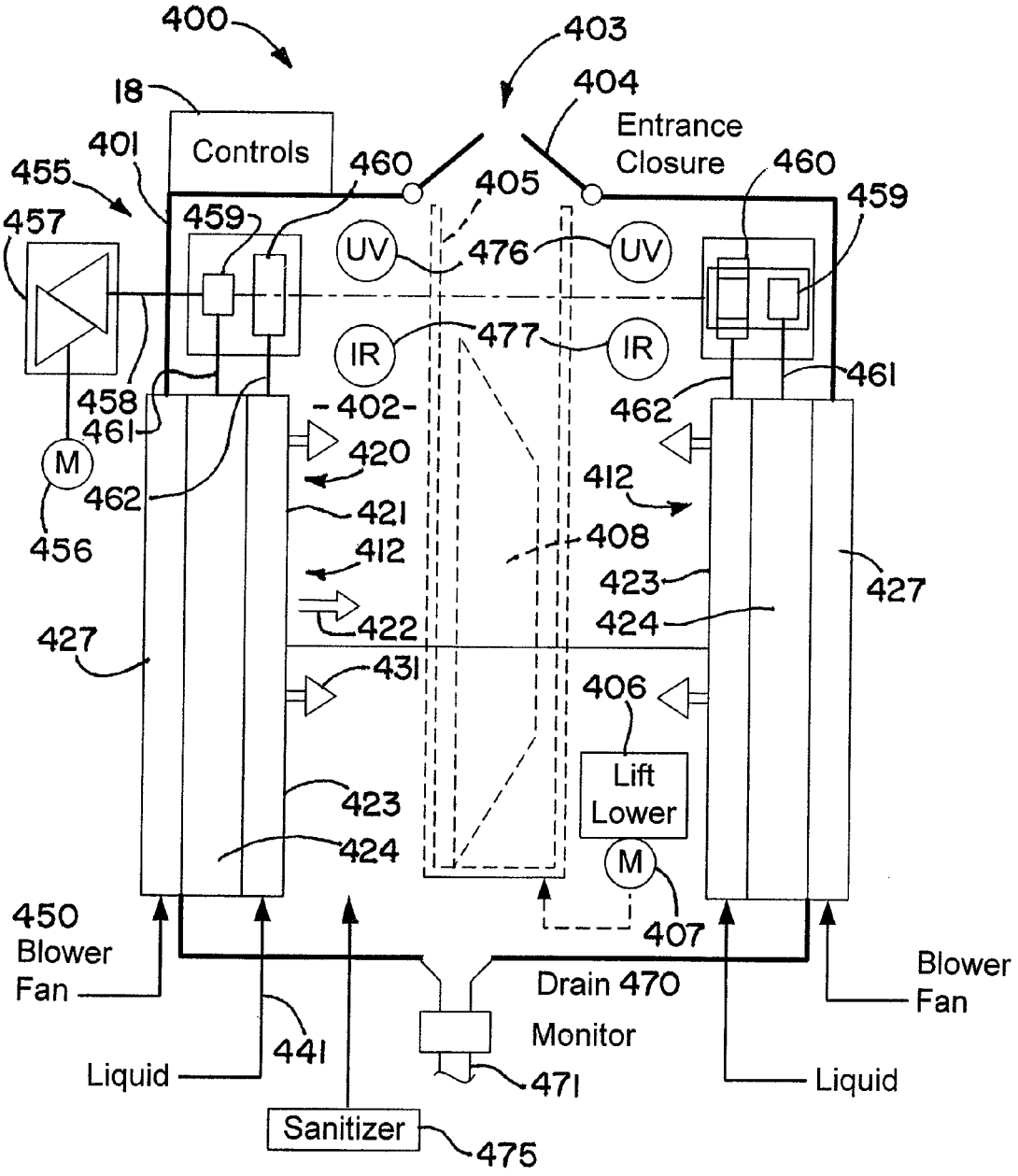
FIG. 1 is a schematic front elevation view of a washing and drying apparatus, e.g., a dishwasher for washing and drying an object, e.g., a dish, one at a time, in a chamber with dispenser apparatus for directing washing fluid and drying fluid at the respective opposite sides or faces of a dish, for example.

Features that are described and/or illustrated with respect to one embodiment may be used in the same way or in a similar way in one or more other embodiments and/or in combination with or instead of the features of the other embodiments. For example, the features of the dishwasher of FIGS. 1-7 using two rotating discs to obtain a spiral air flow may be used in the dishwasher of FIGS. 8-19, and vice-sera, or in the hand washing and drying devices of FIGS. 20-21.

It should be emphasized that the term "comprises/comprising" when used in this specification is taken to specify the presence of stated features, integers, steps or components but does not preclude the presence or addition of one or more other features, integers, steps, components or groups thereof.

Many aspects of the invention can be better understood with reference to the following drawings. The components in the drawings are not necessarily to scale, emphasis instead being placed upon clearly illustrating the principles of the present invention. To facilitate illustrating and describing some parts of the invention, corresponding portions of the drawings may be exaggerated in size, e.g., made larger in relation to other parts than in an exemplary device actually made according to the invention. Elements and features depicted in one drawing or embodiment of the invention may be combined with elements and features depicted in one or more additional drawings or embodiments. Moreover, in the drawings, like reference numerals designate corresponding parts throughout the several views and may be used to designate like or similar parts in more than one embodiment.

DESCRIPTION

The dishwasher 400 (FIGS. 1-7) and 10 (described below with respect to FIG. 8 and more) includes a housing or casing 10*a* having a washing chamber 11 (sometimes referred to as "chamber") and two washing and drying units 12, 12' (also referred to as "dispensers") therein. Briefly referring to FIG. 8 and following), a fluid dispenser 12 includes a washing fluid dispenser for providing washing fluid to wash a dish and a fluid outlet 13 that provides a flow of fluid for directing drying air (or other fluid) against a dish 14 in the chamber 11. The flow of fluid is to dry the dish. The pattern with which the flow impinges against a surface of the dish is generally spiral. Air flow against the dish tends to provide some drying by evaporation but also tends to urge liquid, e.g., wash water that is on the dish, off the dish. The generally spiral pattern of impingement tends to urge the water not only from the center area of the dish but also from the edges of the dish. The spiral air flow tends to cause a disruption of surface tension causing water to release from the dish surface to leave the dish dry. This disruption and pushing water occurs not only at the main face of the dish but the spiral air flow also pushes water off the perimeter or edge of the dish 14*e*.

Referring to FIGS. 1-7, and initially to FIG. 1 a washing apparatus with spiral air flow for drying is shown at 400. The apparatus 400 is described with respect to being a dishwasher 400 to wash and dry dishes, etc., but it will be appreciated that the apparatus 400 may be used for washing and drying other objects, as is described in further detail below. For convenience the apparatus 400 will be referred to below equivalently as apparatus or as dishwasher.

The dishwasher 400 includes a housing 401 in which there is a chamber 402 in which an object to be washed and dried may be placed. As is described below, the object may be a dish, bowl, glass, cup, and so on and the object may be one or both hands of a person (see FIGS. 20 and 21). The dishwasher has an entrance opening 403 at the top with doors 404 that may be closed while an object is being washed and dried to prevent water from splashing out from the chamber. Alternatively, the entrance may be at a side of the housing. The entrance is configured to receive only one dish or other object to be washed and dried at a time; and the size of the housing and chamber also are sized and shaped to receive and to wash and dry usually only one object at a time.

A basket 405 and a lift mechanism 406, including a motor 407, various linkages, belts, gears and/or the like may be provided to receive a dish 408 for washing and drying. The apparatus will be described below with respect to a dish, but it will be appreciate that the apparatus may be used with other objects, e.g., bowls, glasses, cups, and so on, as well as with the hand(s) of a person. The basket 405 and lift mechanism 406 may raise the dish for removal through the entrance 403 after washing and drying. The basket and lift mechanism may operate in a manner similar and provide motion that is similar to that of a vertical bread toaster in which a slice of bread may be inserted and removed.

Various features and operation of the dishwasher 400 are similar to those described below with respect to the dishwasher 10 (FIG. 8 and following) except as is described in detail just below with respect to FIGS. 1-7.

The dishwasher 400 includes two fluid dispenser units 412, which may be of the same configuration and are illustrated and described in further detail below with respect to FIGS. 3-7. Each fluid dispenser unit 412 is configured so that during washing operation or a washing step it directs a flow, e.g., a spray, of washing fluid toward a dish 408 for washing dirt off the dish. Each fluid dispenser unit 412 also is configured so that during drying operation or a drying step it directs a flow of air toward the dish to dry the dish; and the air flow is directed to the dish so that it is in a spiral pattern as it impinges on the dish.

Each dispenser unit 412 includes a washing fluid dispenser 420 configured to direct a spray of wash fluid to an object, e.g., dish 408, in the chamber 412 to wash the object, and a drying fluid dispenser 421 configured to direct a flow of drying fluid at an object in the chamber to dry the object. The drying fluid dispenser directs a flow of drying fluid 422 in a spiral pattern as the drying fluid is directed toward the object.

Figure 3:
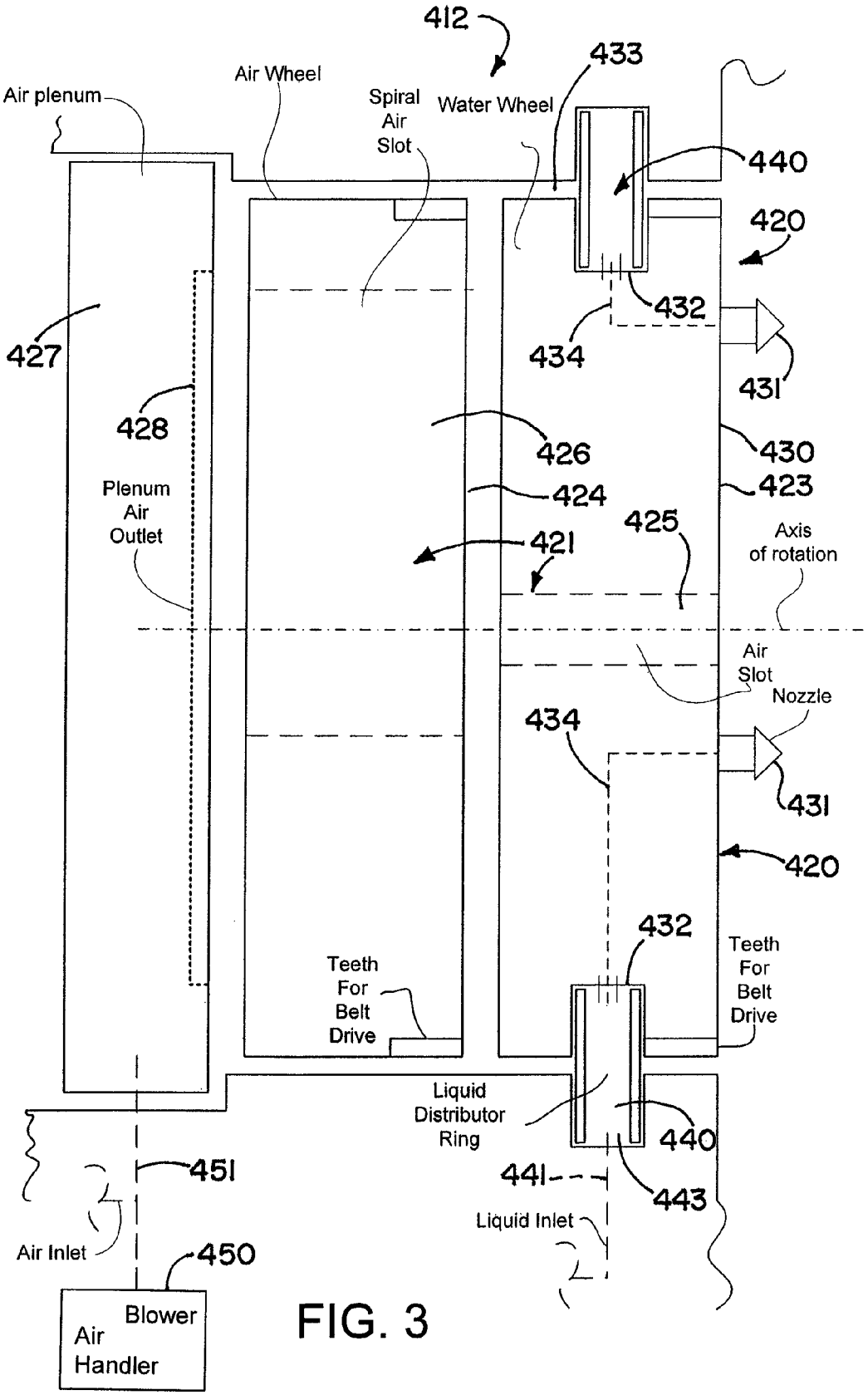
FIG. 3 is a schematic illustration of a washing and drying unit (also referred to as a dispenser) for use in a washing and drying apparatus in accordance with an embodiment of the invention.

The drying fluid dispenser 421 includes a pair of relatively rotatable discs 423, 424, one (423) having at least one elongate, slot 425 therethrough and the other (424) having at least one curved slot (426) therethrough. As is seen in FIG. 3, the pair of rotatable discs are aligned in sequential flow relation to each other such that drying fluid provided the apparatus first flows through one of the slots (the spiral shape or curved slot 426 of the disc 424) and subsequently flows through the other of the slots (slot 425 of the disc 423). In response to the discs rotating at different speeds of rotation the slots are configured to direct the flow of drying fluid in the chamber toward an object to be dried in a spiral pattern against a surface of such object. Where the slots align to permit flow therethrough air flows from an air plenum 427 through a plenum air outlet 428 to aligned portions of the slots into the chamber; and as the discs rotate, that flow takes on a pattern that impinges as a spiral shape against the dish in the chamber. The slots 425, 426 extend fully through the respective discs from one face to the other; but air only exits from that part of one slot that is currently aligned with a corresponding part of the other slot.

The disc 423 includes a support 430 for one or more nozzles 431 to spray washing fluid toward an object in the chamber. An annular recess or groove 432 about the edge perimeter 433 of the disc 423 receives washing fluid therein from a source of washing fluid, as is described further below. A flow path 434 is provided from the annular recess to respective nozzles 431. A separate flow path 434 may be provided to each nozzle or the same flow path may be provided to reach each nozzle. In the illustrated embodiment the flow path 434 is drilled into or is molded into the disc 423. The flow path 434 conducts washing fluid from the annular recess 432 to one or more respective nozzles.

A source 440 of washing fluid is coupled in generally fluidically sealed relation with the annular recess 432, whereby while the one disc rotates washing fluid is supplied to the annular recess for coupling via the flow path(s) 434 to the nozzle 431. The washing fluid is a liquid and it may be provided by a fluid connection for a supply of fluid, e.g., a water faucet, water pipe, or other supply of fluid, coupled to a liquid inlet 441 from which washing fluid is provided the annular recess 432. As is illustrated in FIG. 3, disc 423 is mounted in a housing 442, and an annular recess 443 in the housing 442 receives fluid, e.g., is fluidically coupled to, from the liquid inlet 441. Thus, the annular recesses 432 and 443 directly face each other and extend generally circumferentially about the circumference of the disc 423 so that fluid from the liquid inlet 441 that is provided the annular recess 443 and tends to fill both the annular recess 443 and the annular recess 432 to provide washing fluid to the nozzles 431. A pair of annular rings or washers are in both annular recess 432, 443 and extend fully circumferentially about the respective annular recesses to provide a seal to prevent washing fluid from leaking out from the intended flow path from the liquid inlet 441, through the annular recesses 432, 443 and via the respective flow paths 434 to the respective nozzles.

A blower or air handler 450 provides air under pressure via an air inlet 451 into the plenum 427 for delivery via the plenum air outlet 428 to the slots 426 and 425 for blowing on a dish in the chamber.

A drive mechanism 455 is provided to rotate the discs 423, 424. The drive mechanism 455 includes a motor 456 that provides rotational effort via a transmission 457 to turn a drive shaft 458. Mounted on or separately mounted and driven by the drive shaft 458 are two gears or transmission 459, 460 that are coupled by respective belts 461, 462 (or other linkage) to the discs 423, 424 to rotate the discs. The gears 459, 460 may be part of respective transmissions. The gears 459, 460 are of different diameters and are designed so that the gear 459 rotates the disc 424 once for every five rotations of the disc 423. This relationship is exemplary; other relationships or ratios may be used. Thus, the manner of relative rotation of the discs 423, 424 at different speeds and the slots thereof cooperate to provide for the spiral pattern of air flow toward a dish 408.

Figure 4:
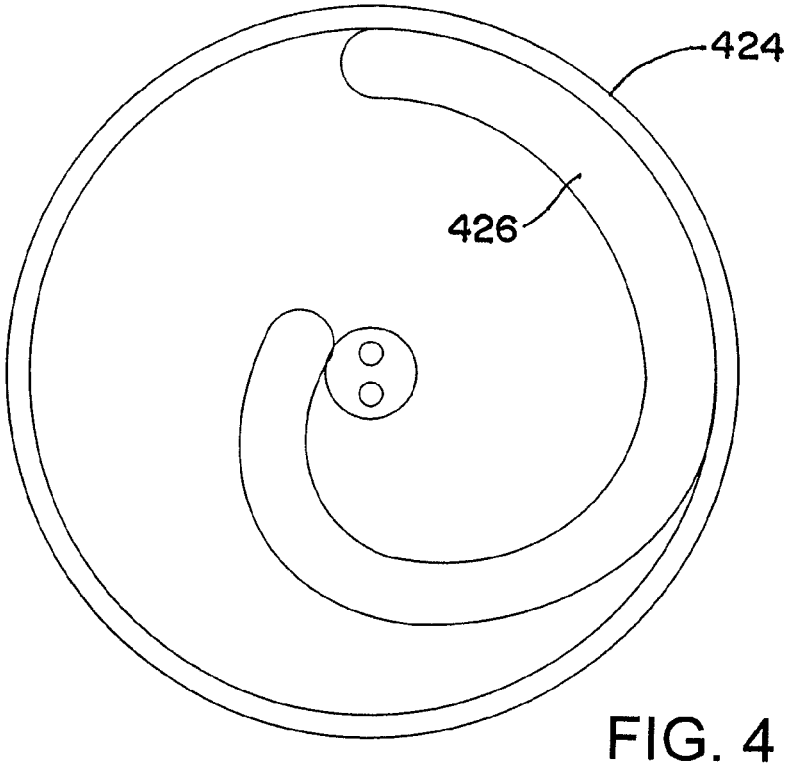
FIG. 4 is a schematic front plan view of a spiral slotted disc of a washing and drying unit of FIG. 3.
Figure 5:
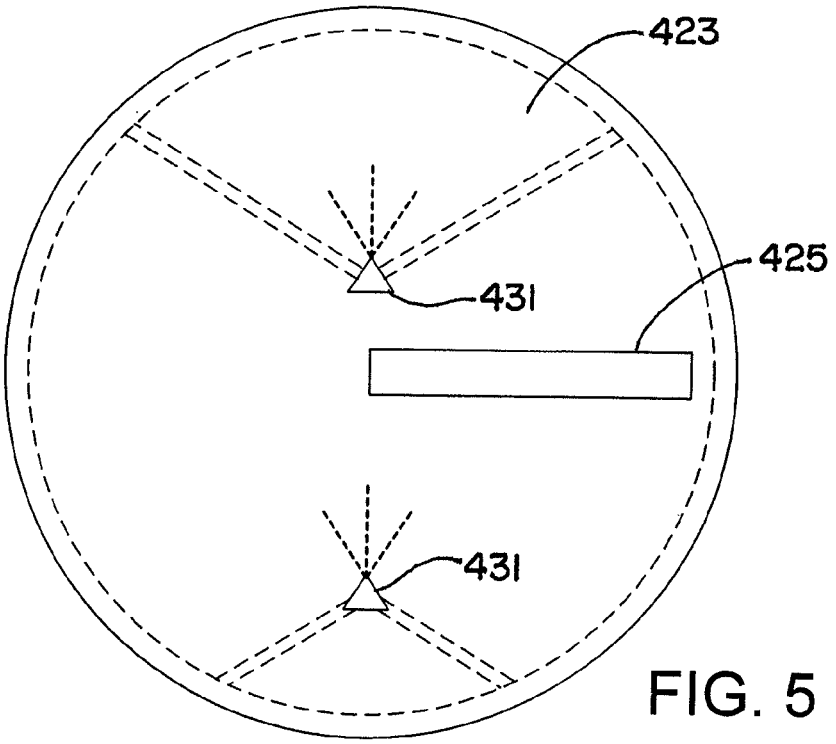
FIG. 5 is a schematic front plan view of another disc with a linear air directing slot and with washing fluid dispensing nozzles of a washing and drying unit of FIG. 3.
Figure 6:
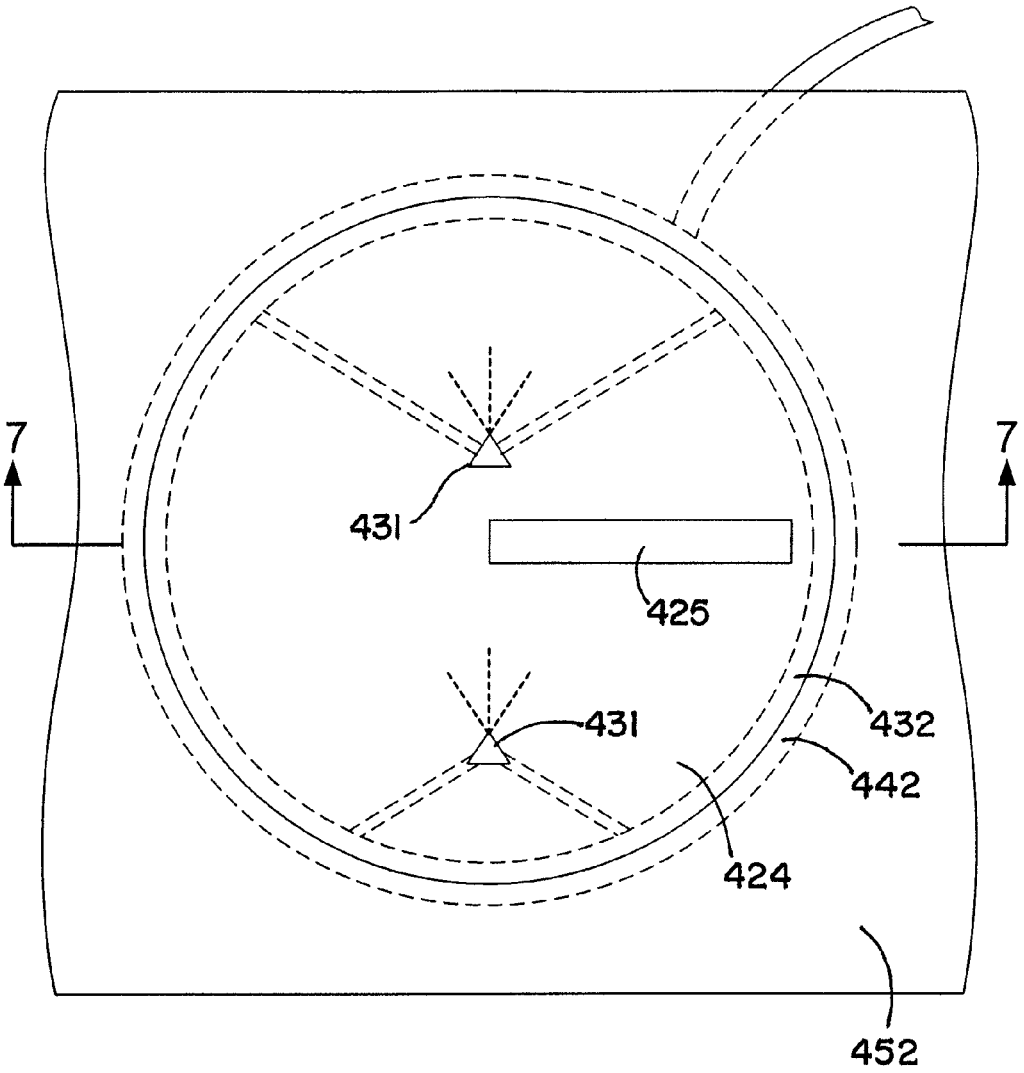
FIG. 6 is a front plan view of the disc with linear air directing slot and washing fluid dispensing nozzles in position with respect to a housing to receive in an annular recess a supply of washing liquid for delivery to the washing fluid dispensing nozzles.
Figure 7:
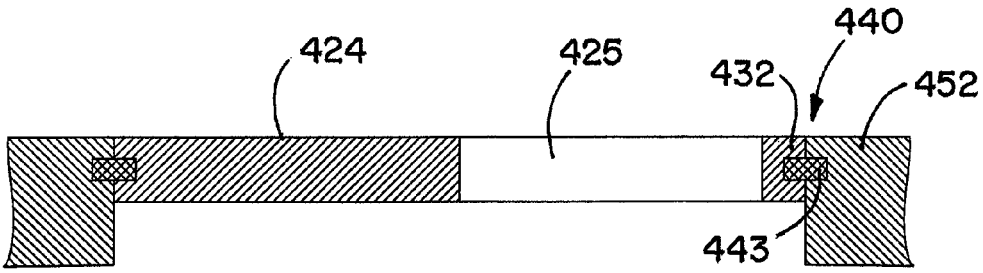
FIG. 7 is a section view of the disc of FIG. 6 looking in the direction of the arrows 7-7.

As is seen in FIG. 4 the slot 426 extends through the disc 424 from one face to the other (one face facing up in the illustration and the other face being into the plane of the drawing). The slot 426 is curved and in the exemplary embodiment is generally of a spiral shape or configuration. The slot 425 in the disc 423 also extends through the disc from one face to the other and is generally straight. The precise shapes of the slots is not necessarily critical, but the relationship between the slots so that a desired flow pattern of air impinging on a dish to obtain desired extent of drying is preferred.

As is mentioned above, the basket 405 is a holder configured to hold an object to be washed in the chamber 402.

Figure 20:
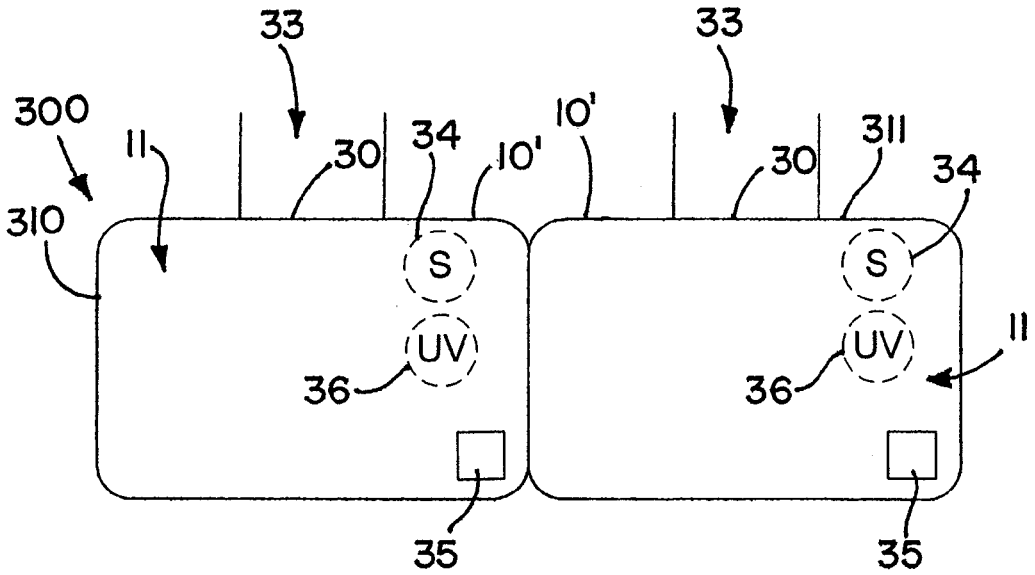
Figure 21:
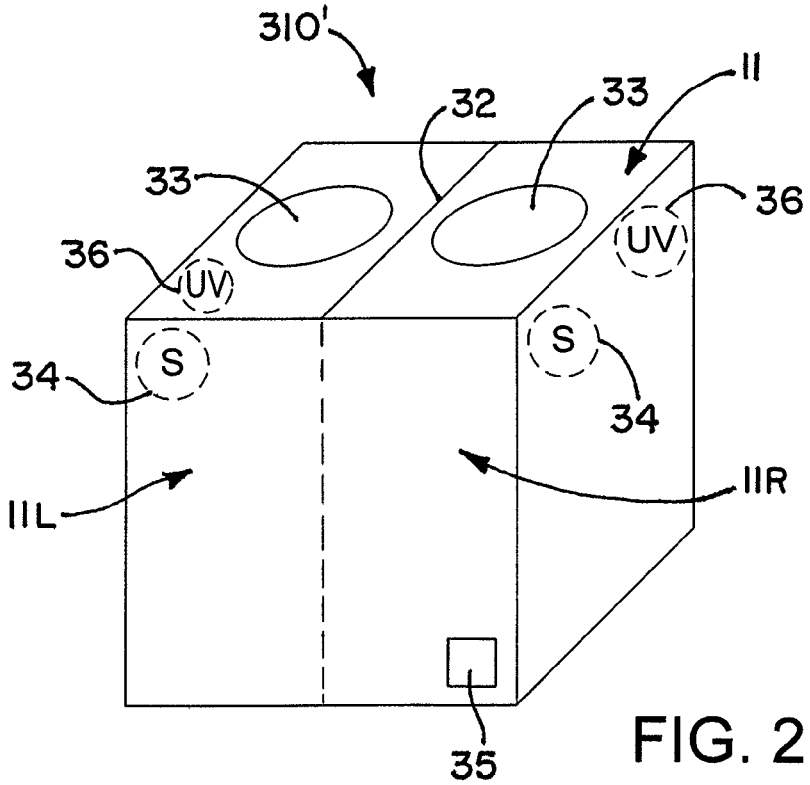
FIG. 21 is a schematic illustration of a hand washing device that uses a washer as in the embodiments of FIG. 1 or 8, but without a basket for dishes and with two openings in the top to place hands for washing and drying in the chamber.

In an embodiment that uses the features of the apparatus 400 the basket and associated parts of the holder 405 can be eliminated, and the apparatus may be used to wash and to dry the hands of a person, e.g., as is illustrated schematically in either or both of the embodiments 300, 310' of FIGS. 20 and 21. Such apparatus includes openings for placing one or more hands of a person into the chamber for washing and drying of the hands, e.g., as in FIGS. 20 and 21.

A drain opening 470 in the bottom, e.g., at a sump area, of the dishwasher housing chamber 402 couples liquid to a drain pipe 471 to appropriate waste or for recycling. A monitor 472 is coupled between the drain 470 and drain pipe 471 to monitor the condition of the liquid flowing through the drain and drain pipe to determine the extent of washing, e.g., is more washing needed or has washing been completed, e.g., is the dish clean yet or not. The monitor may be an optical device that directs light through the liquid and detects the light transmission through the liquid. Many types of turbidimeters exist that may be used for such purpose. Electrical monitors also may be used to measure electrical conductivity or impedance in the liquid. The output from the monitor may be coupled to the controls 18 that may control operation of the apparatus 400 based, for example, whether the liquid is quite dirty, indicating dish still dirty, or the liquid is quite clear, indicating that the dish is clean.

The lift and lower mechanism 406, 407 and the basket 405 receives an object in the chamber and lowers the object into the chamber for washing and drying of the object and lifts the object for convenient removal of the object.

A sanitizer dispenser 475 may be provided to dispense detergent and/or sanitizer into the chamber 402. Moreover, a source 476 of ultraviolet light providing ultraviolet light in the chamber for sanitizing, e.g., for killing germs, bacteria or the like. Infrared light source(s) 477 also may be provided for sanitizing or for warming the washing fluid or drying air or for warming the object 408. The controls 18 may control operation of the sanitizer 475 and sources 476, 477. The controls 18 also control other parts and operation of the dishwasher apparatus 400. For example, controls 18 are configured to control the flow of washing fluid and drying fluid to wash and dry an object in the chamber.

The apparatus and various parts thereof may be controlled by the controls 18 to cause both the washing fluid dispenser and drying fluid dispenser to direct a simultaneous flow of washing liquid and air toward an object 408 during the washing part of a cycle of operation of the apparatus 400. Thus, impingement of washing liquid and air on the object 408 increases the energy of the impinging fluid to enhance the washing function.

In an embodiment, the wall(s) of at least part of the chamber 202 may be transmissive of light to permit viewing inside the chamber while an object is being washed and/or dried. Moreover, wherein that part of the chamber that is transmissive of light may be reflective or non-transmissive of ultraviolet light to avoid leakage thereof outside the chamber.

Using the apparatus 400, washing and drying may be carried out by directing a flow of washing fluid at an object in a chamber to wash the object and directing a flow of drying fluid at the object in a spiral pattern. According to an embodiment the flow of drying fluid at the object is provided both while the object is being washed by washing fluid and while the object is being dried while washing fluid is not directed at the object.

Figure 8A:
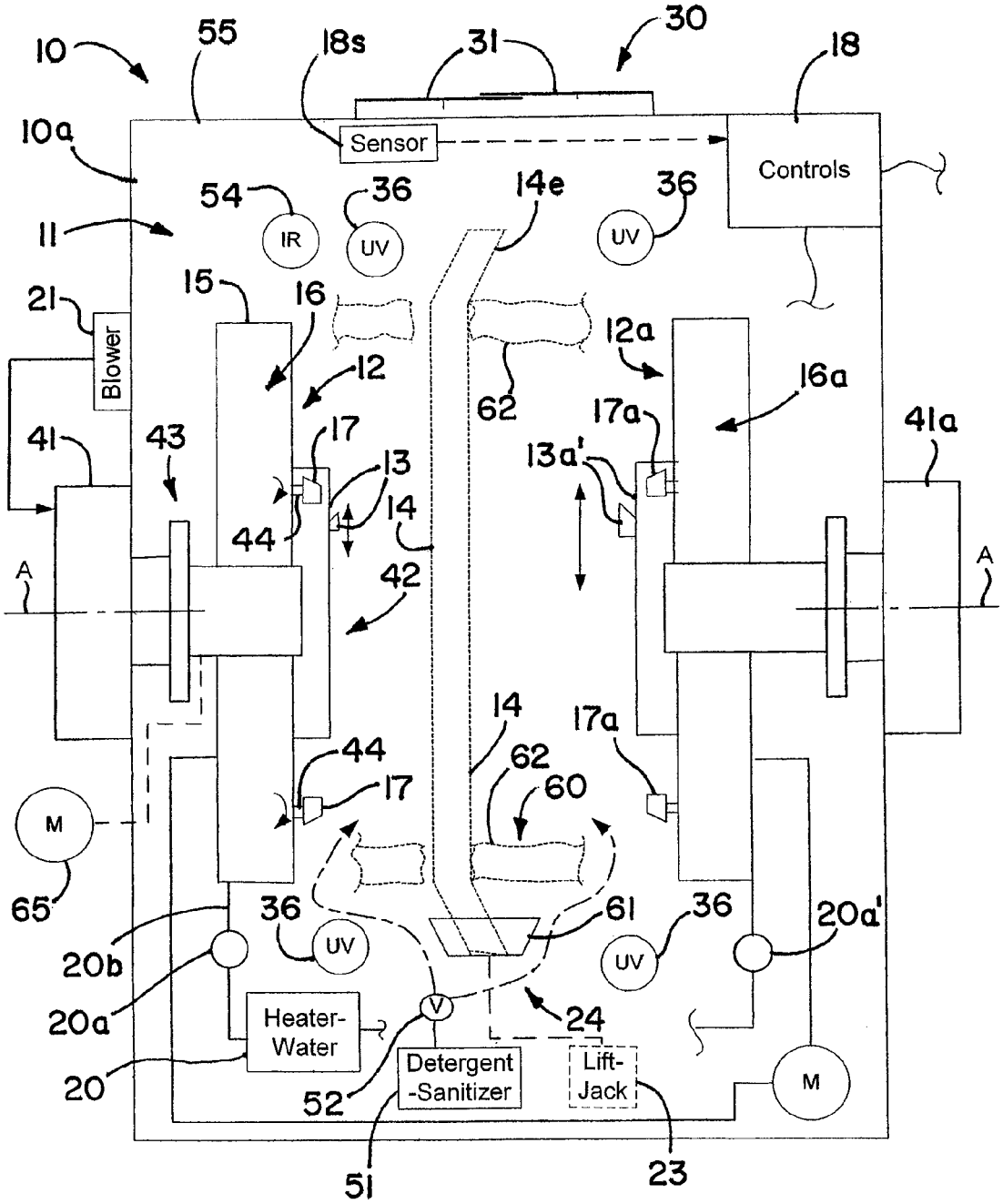
FIG. 8A is a schematic illustration of a dishwasher with dispensers to wash and dry one dish at a time.

In FIG. 8A there are two dispensers 12, 12*a* in the chamber 11 one positioned on each side of the chamber 11 to wash and dry each respective side of a dish. Each dispenser may be the same or substantially the same; like parts may be designated or described using the same reference numeral but with a suffix "a" or a prime sign. Each dispenser includes a support 15 that is part of a plenum (also referred to as reservoir) 16 in which water is provided for washing a dish. Rotating nozzles 17 are mounted on the support and are coupled to fluid in the plenum to spray the water on the dish. The support 15 is rotatable about axis A. The fluid outlet 13 is movable on the support 15 in a reciprocating linear path so that as the support rotates the air flow from the fluid outlet impinges on the surface of the dish in a generally spiral pattern of impingement.

A water supply 20 provides water to the plenum (reservoir) 16. The water supply 20 may include a heater to heat the water to improve washing function, for example. A blower 21 supplies air to the fluid outlet 13. Flow of air and water and rotation and reciprocating motion are controlled by the control 18, also shown in FIG. 19. These are described further below.

A jack 23 may lift up a basket 24 in the chamber 11 to receive a dish 14 placed thereon and may lower the dish into the chamber for washing and drying. An entrance 30 is provided for only one dish at a time into the dishwasher chamber 11 via doors 31 that may be rigid or flexible and may close the entrance to prevent splashing of water outside from the chamber.

Figure 13:
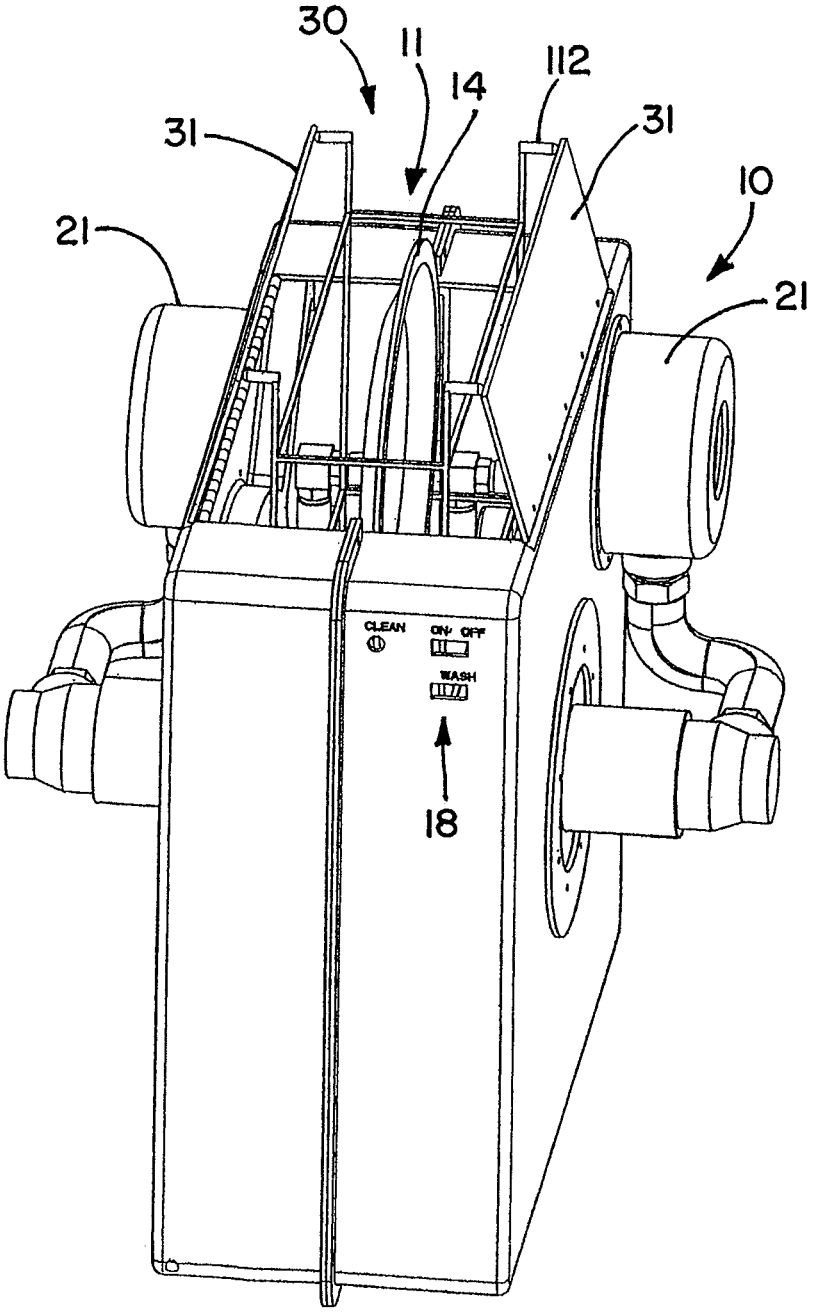
FIG. 13 is an edge/front isometric view of the dishwasher with the entrance open and one dish shown in the washing chamber in the dishwasher housing or case.
Figure 14:
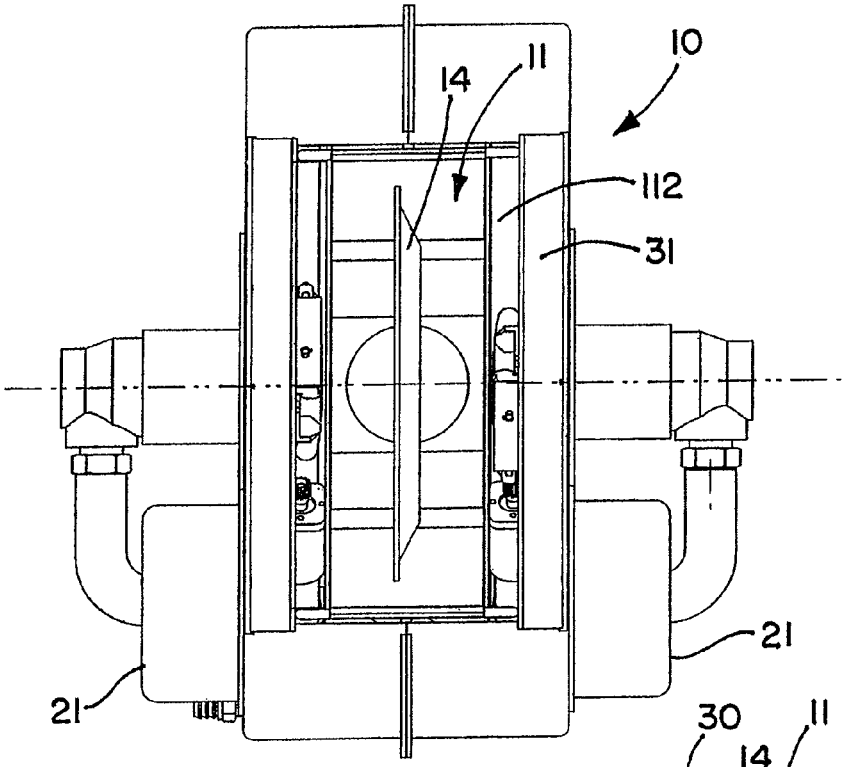
FIG. 14 is a top view of the dishwasher looking down into the top of the dishwasher with a dish therein.

In FIGS. 13 and 14, there are two similar devices 10' similar to the dishwasher 10 or may be a single device similar to the dishwasher 10 but with a separator 32 that extends somewhat vertically between the dispensers 12. A person may insert his or her hands into the chamber 11 through openings 33 and the hands will be washed and dried by operation of the dispensers as described herein. Sensors 34 may sense placement of the hands in the chamber 11 and turn on via controls 35 an operative cycle of the dispensers to wash the hands and dry them. Thus, water is saved because there is no need for a constantly running faucet; power is saved because there is no need for a long operating conventional hand dryer blower. Also, ultraviolet radiation from a UV source 36 may be provided in the chamber for sanitizing the hands. Similarly ultraviolet radiation may be provided in the chamber 11 of the dishwasher 10 shown in FIG. 8A to sanitize dishes.

Continuing to describe the dishwasher 10 in FIG. 8A, a blower 21 provides a flow of air to an air plenum 41. Air flow from the blower 21 and air plenum 41 flows through tubing, passages or the like generally shown at 42 so as to reach the fluid outlet 13 for distribution against the surface 14*s* of a dish 14 in the dishwasher chamber 11 to dry the dish.

The tubing and passages 42 may be part of a support structure generally illustrated at 43 that supports the plenum 16, which contains water intended to be distributed via the nozzles 17 against the dish 14 to wash the dish. The nozzles 17 may be mounted on nozzle supports 44 to receive water from the plenum and to allow the nozzle to rotate under the force supplied to the nozzle as water is distributed out from the nozzle against the dish. This may be referred to as a reaction type force as the water is distributed out from or is forced out from one or more respective orifice of the nozzles 17. If desired the nozzle supports 44 and nozzles may be fixed such that in operation of the dishwasher they do not rotate relative to the plenum (reservoir) 16.

The plenum 16 is rotatable about or rotatable with the support structure 43 so that the water pattern against the dish 14 is somewhat circular as the plenum rotates and, if the nozzles are rotatable on nozzle supports, also is somewhat random as each respective nozzle 17 individually and independently rotates under the reaction force from the water spraying toward the dish from the respective nozzle.

Water may be supplied by a schematically illustrated water supply 20 that is connected to provide water to the plenum. The water may be heated at the water supply 20, and, therefore, in the illustration of FIG. 8A the water supply is shown as a heater-water, whereby the water is heated and is supplied under suitable pressure to the plenum. There may be a valve 20*a* in a water line 20*b* from the water supply 20 to the plenum to direct water under suitable control to the plenum. For example, when washing is desired, the controls 18 may open the valve 20*a* to supply water via the waterline 20*b* to the plenum 16 from the water supply 20. This may occur when it is desired to spray water at a dish to wash the dish. Thus, water is sprayed against one side of the dish via the nozzles 17 and water is sprayed against the other side of the dish via the nozzles 17*a*.

During washing of a dish, if desired, a detergent and/or sanitizer may be supplied from a source 51 thereof via a valve 52 and suitable pipes, tubes, or the like. The detergent and/or sanitizer may be sprayed into the chamber 11 so as to impinge on the respective surfaces of a dish 14 and/or to mix with water being sprayed at the dish during the washing thereof. Operation of the detergent sanitizer device 51 and valve 52 may be controlled by the controls 18 in a suitable cycle that may be automatic or may be selectively controlled by a user.

Ultraviolet light from one or more respective ultraviolet light sources 36 may be used to shine on or to irradiate a dish 14 to kill bacteria and/or for other purposes, e.g., to sanitize the dish 14 and/or to sanitize the chamber 11 and parts therein. UV (ultraviolet) radiation may be provided at suitable strength and at appropriate times, e.g., during the washing and/or drying of the dish.

One or more infrared sources 54 may be provided in the chamber 11, one of which is illustrated as an example, to warm the chamber and/or a dish 14 therein to enhance the washing process and/or simply to warm the dish so that it feels warm when it is removed from the dishwasher. The infrared sources 54 also may heat the dish to enhance drying. Operation of the infrared source 54 and operation of the ultraviolet sources 36 may be controlled by the controls 18 automatically or manually by a user.

The entrance 30 and doors 31 may operate to substantially close the chamber 11 after a single dish has been placed therein. The entrance and the doors are of suitable size and material and shape to permit only one dish at a time to be inserted into the chamber 11 and to be withdrawn from the chamber or removed from the chamber. The size and shape and material of the entrance 30 and doors 31 may be such that they tend to block spraying of water out from the chamber during washing and also prevent removed water from the surface of a dish during drying from exiting the chamber via the entrance. The placement, size, shape of the entrance 30 and doors 31 and material of which they are made as well as the shape and material of which the exterior walls 55 of the chamber 11 are made tend to prevent infrared light and ultraviolet light from exiting the chamber. Thus, the walls 55 may include thermal insulation so as to avoid heat from within the dishwasher causing the dishwasher external surface being hot to the touch.

The dish support structure 60 is part of the lift jack mechanism 21, 23 and basket 24. The dish support structure 60 includes, for example, a bottom support 61 on which a dish may be placed within the dishwasher chamber 11. The purpose of the lift jack mechanism 21 is to allow a dish to be inserted via the entrance 30 and doors 31 into the dishwasher chamber 11 and to be lowered fully into the dishwasher chamber for washing and drying; and after the dish has been washed and dried, the lift jack mechanism 21 may raise the dish out through the entrance 30 and doors 31 to be removed, for example, by a user manually grasping the dish to complete the removal—the dish being washed and dried at that point.

The lift jack mechanism 21 includes a motive device, e.g., a motor 61*a* (FIG. 4), appropriate gearing, support mechanisms, and so on generally indicated at 23. Additionally, the lift jack mechanism 21 includes a bottom support 61 on which the dish 14 may rest as it is lowered into and raised up from the washing position, which is illustrated in FIG. 8A in position to be washed by water distributed from the nozzles 17, 17*a* and dried via the fluid outlets 13, 13*a*. Stabilizers 62 are illustrated in the chamber 11 to stabilize the dish in a generally vertical orientation, as is illustrated in FIG. 8A. The stabilizers 62 may be part of a basket 62*a* (FIG. 11B) in which the dish rests. The stabilizers 62 may be resilient or flexible flaps, e.g., made of rubber or plastic, that may be in position to bear against a dish to hold it in a desired generally vertical orientation. The vertical orientation allows the dish to be washed and water that is on the dish tend to drain vertically downward in the chamber 11 using gravity force and also allows for air to be blown against the dish and also to fling water from the dish not only laterally off the edges of the dish but also from the face of the respective sides of the dish. Gravity and the spiral air flow assist in water draining from the bottom of the dish or dripping from the bottom of the dish and drying of the dish.

In operation of the lift jack mechanism 21, the controls 18 may have operated the lift jack mechanism 21 so that the bottom support 61 is raised to a vertically higher level than is shown in the chamber illustrated in FIG. 8A. In such raised position the bottom edge of a dish may be placed against the bottom support 61. The dish may be pressed downward, and the force of such pressing may be sensed by a sensor providing an input to the controls 18 to cause the controls to operate a motive device in the lift jack mechanism 23 to lower the dish fully into the chamber 11. Alternatively, a sensor 18*s* (FIG. 8A) may sense the presence of a dish, e.g., a photoelectric sensor, a feeler sensor, or some other type of sensor, and upon sensing the locating of a dish or the passing of a dish into the entrance 30, a signal may be sent to the controls 18 to cause the lift jack mechanism 24 to commence lowering the bottom support 61 to the position shown in FIG. 8A. The stabilizers 62 may be arrange so that during the raising and lowering of the bottom support 61 they do not interfere with such motion. After the dish has been washed and dried the lift jack mechanism 24 may raise the dish upward so that the top edge of the dish at least is exposed from the entrance 30 and doors 31 to the outside of the dishwasher for a user to manually grasp the dish and to remove it from the dishwasher.

With a dish 14 in the chamber 11, the controls 18 may operate the valves 20*a*, 20*a*' to provide water under pressure to the plenums 16 so that water to wash the dish is directed via the nozzles 17, 17*a* against the dish to wash the dish. The water may be heated by the heater-water supply 20. The detergent-sanitizer 51 may dispense detergent and/or sanitizer during the washing process. The infrared energy and ultraviolet light may be provided during the washing process and/or during the drying process. After the washing has been suitably completed, e.g., for a suitable period of time, the controls 18 may stop water flow by closing valves 20*a*, 20A'. At this point the controls 18 may operate the blower 21 to supply air via the air plenum 41 to the fluid outlets 13, 13*a* and 13, 13*a*' to blow air against the dish to dry the dish.

The aforementioned operation may be entirely automatic under the operation of the controls 18 or may be partly automatic and partly manually controlled by a user. Alternatively, operation may be entirely manually operated by a user that selects washing and selects drying functions, for example.

During the washing and/or drying cycles of operation described above a motor 65 provides a motive input to the support structure 43 for the plenums 16, 16*a* causing them to rotate. As they rotate, the respective nozzles 17, 17*a* rotate with the plenums and also, if independently rotatable, rotate under the reaction force of the water spraying out from the orifices thereof. Thus, a broad or wide pattern of washing water against the surfaces of the dish 14 occurs during the washing operation. Moreover, during the drying operation, the motor 65 also causes rotation of the plenums 16. As is described further below, the fluid outlets 13 that dispense air for drying the dish are mounted with respect to the plenums and also themselves are movable relative to the plenums to provide a spiral air flow pattern against the surface of a dish to dry the dish.

Although the various parts described above are described as mounted with respect to each other, it will be appreciated that other mounting arrangements may be provided. The illustration in FIG. 8A is intended to be exemplary of an embodiment of the invention. Other arrangements of parts may be used to provide an equivalent operation for washing and drying. For example, the fluid outlets 13 for the air directed against the surfaces of the dish for drying may be mounted on a structure other than the plenum 16, e.g., they may be mounted on another support that rotates so that the spiral pattern that is described further below is obtained for the air directed at the surfaces of the dish. Similarly, the nozzles 17, 17*a* may be mounted on a structure other than the plenum 16 but in any event receive water flow to wash the dish and also preferably to allow for rotation of the nozzles to obtain a broad washing fluid pattern against the surface of the dish.

Figure 9:
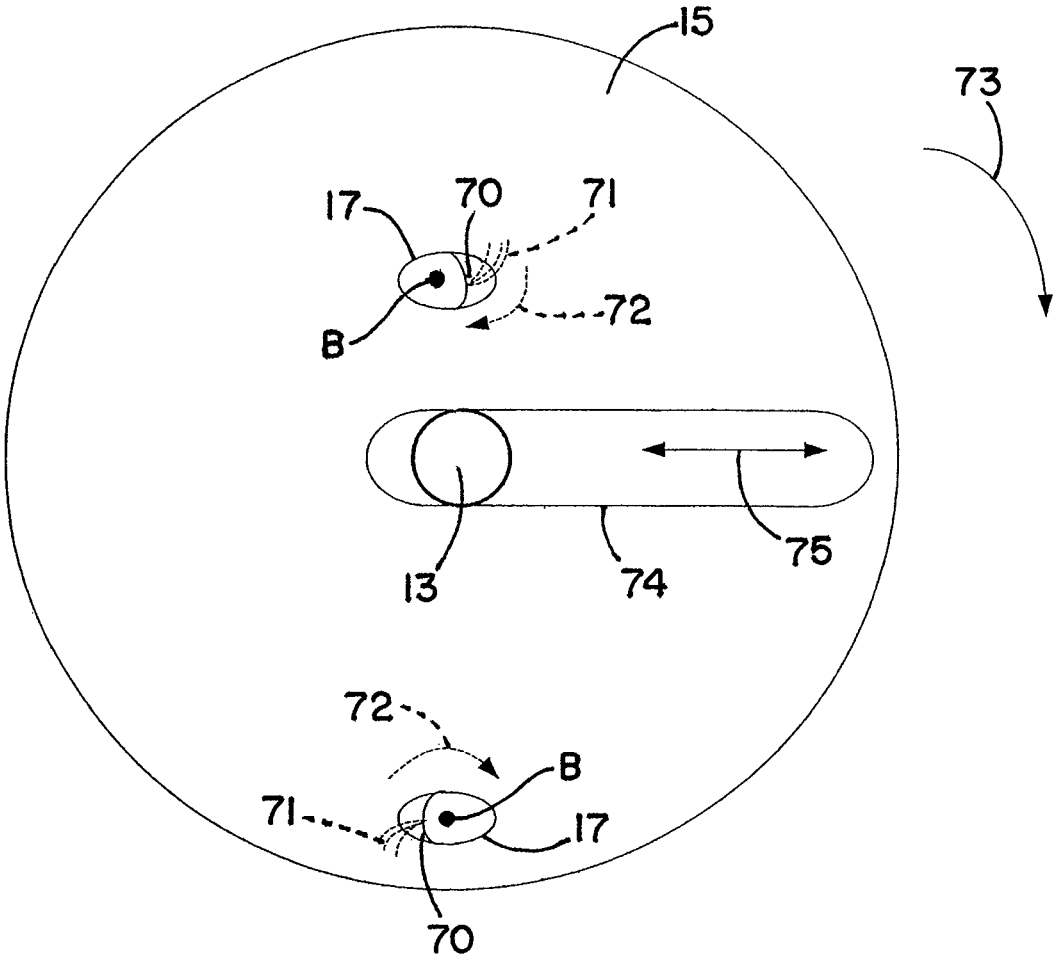
FIG. 9 is a schematic illustration of a support on which liquid washing nozzles are mounted for rotation about their respective axes, a slot in the support, and a fluid outlet slidable in the slot to provide a generally spiral pattern of fluid to impinge against a surface as the support rotates and the fluid outlet slides in the slot while fluid is dispensed from the fluid outlet.
Figure 10:
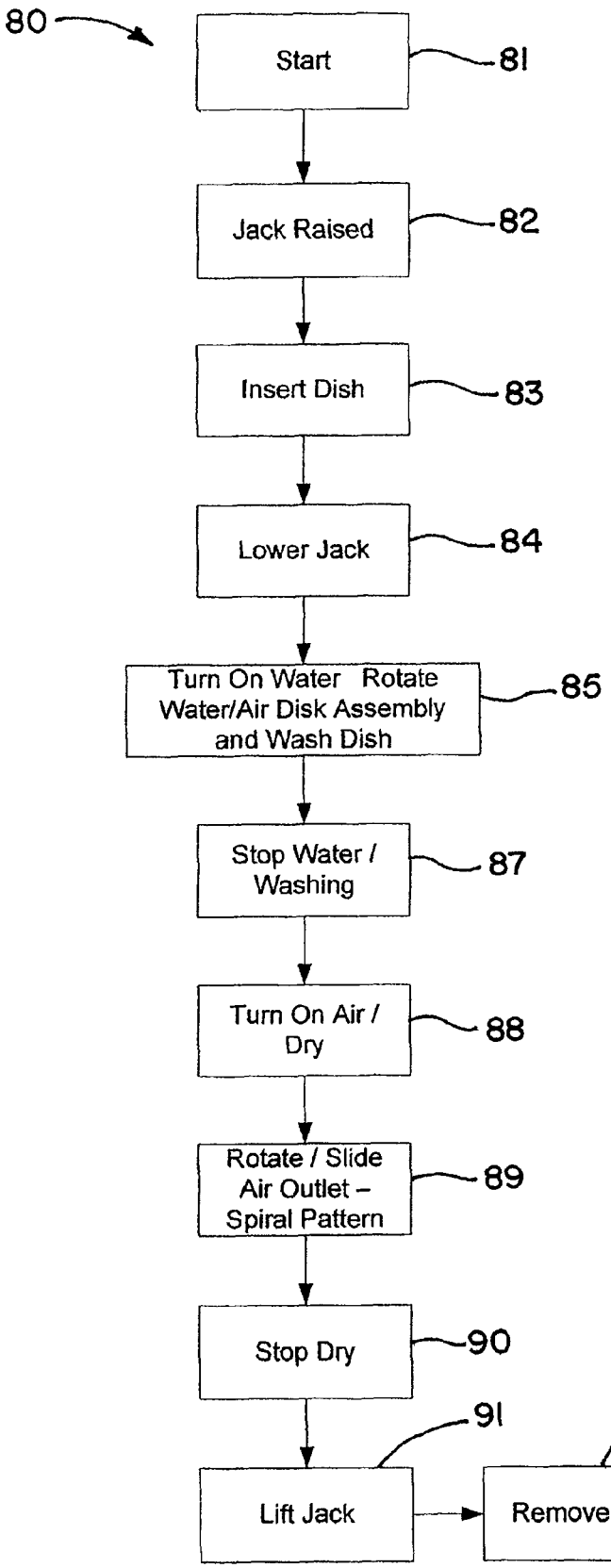
FIG. 10 is an exemplary flow chart illustrating steps for washing and drying one dish at a time in the dishwasher.
Figure 11A:
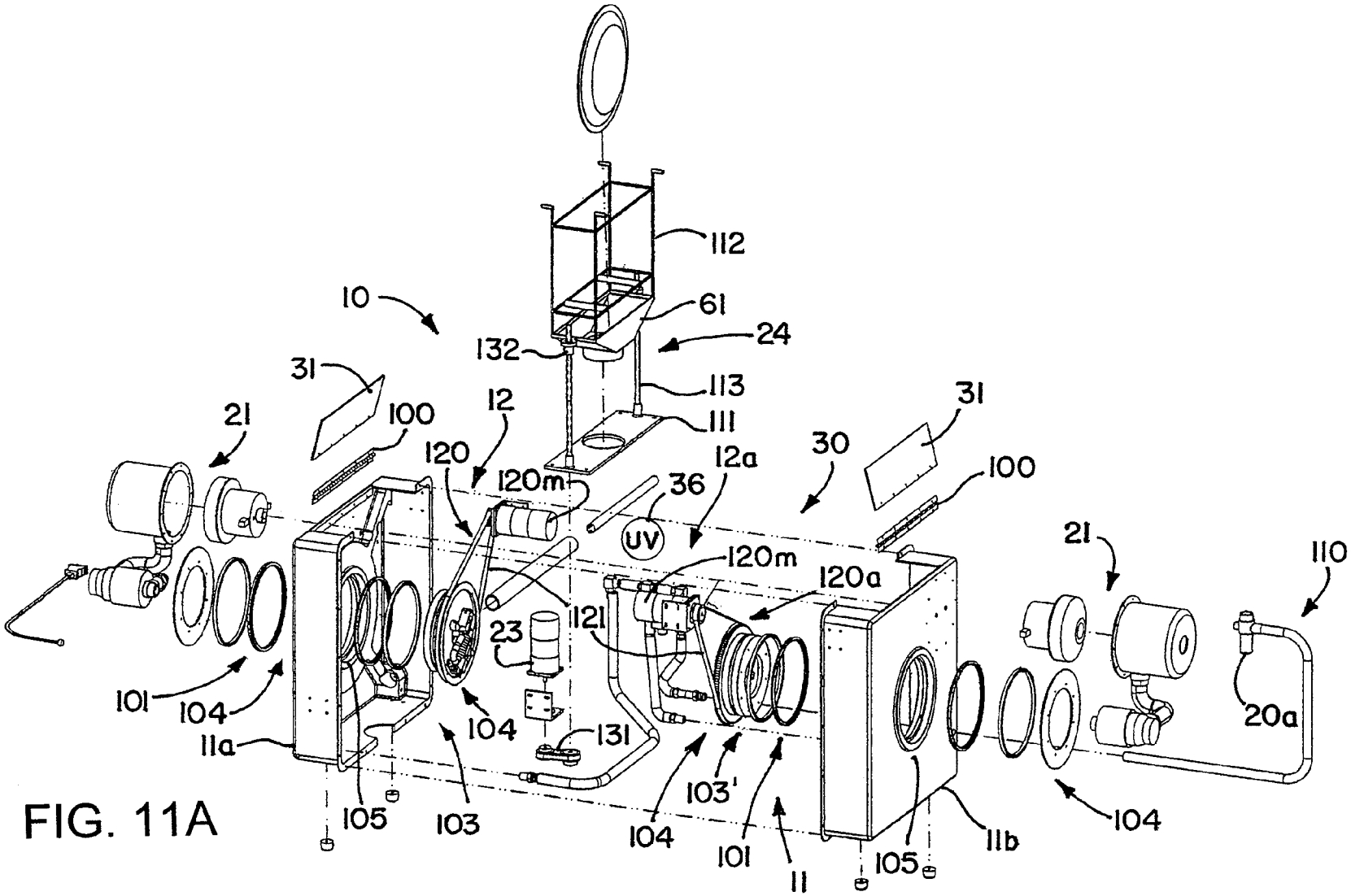
FIG. 11A is an exploded isometric view showing details of the dishwasher.

Turning to FIG. 9, a schematic illustration showing relative positioning and operation of the fluid outlet 13 (for air) and the rotating nozzles 17 (for water) is illustrated. With regard to the rotating nozzles 17 as is shown, each has one or more orifices 70 from which water 71 is dispensed. The orientation of the orifices 70 relative to the structure of the nozzle 17 is such that the outflow of water tends to cause a reaction force to rotate the nozzle 17 about its axis B. An arrow 72 indicates an example of the rotational direction. The support 15 also rotates during operation of the dishwasher in the direction of arrow 73, for example or may reciprocate back and forth in the direction of the arrow 73 and in the reverse direction, as may be desired. The support 15 may be part of the plenum 16 and also of a water/air disc assembly 103 (FIG. 11A).

As is illustrated in FIG. 9, the fluid outlet 13 is mounted to reciprocate in a slot 74 back and forth in the direction of arrow 75. As the fluid outlet moves back and forth along the length, (all or part of that length) of the slot 74, and as the support 15 rotates in the direction of arrow 73 or the reverse direction of the arrow 73, for example, the air from the fluid outlet 13 tends to define a spiral-line pattern. Thus, air blown from the outlet 13 toward a surface of a dish 14 moves along the surface of the dish in a spiral pattern moving, for example, from the center of the dish toward the perimeter or edge (sometimes referred to as edge perimeter) of the dish. Water on the surface of the dish tends to be blown away from the surface by the flowing air such that the water bounces off the face of the dish along with air that bounces off and simultaneously the remaining water on the surface of the dish will tend to be pushed toward the outer perimeter of the dish (e.g. outer edge of the dish). Some water also may evaporate. As the outlet 13 reaches the furthest position away from the center of the support (the center being the approximate location that the outlet 13 is illustrated in FIG. 9), water is blown away from the edge (perimeter) of the dish. The air flow tends to break the surface tension allowing the water to be blown away from the edge of the dish.

Further description of such operation is provided below with respect to the other drawing figures.

Thus, during washing and drying operation the nozzles as a whole rotate with the support and the nozzles individually rotate on their respective axes. Moreover, the air for drying is moved generally in a spiral pattern against the surface of the dish as the outlet 13 rotates with the support 15 and also moves laterally long the slot 74 in the direction 75.

Turning to FIG. 3, a schematic illustration of operation of the dishwasher 10 is illustrated at 80. The controls 18 (FIG. 8A) may control operation of the dishwasher 10 according to the flow chart of steps illustrated in FIG. 3 at 80.

At Block (also referred to as step) 81 the dishwasher 10 is started. For example, a user may press a start button that turns on power and energizes operation of the controls 18. At step 82 the lift jack 23 is raised to receive a dish. At step 83 a dish 14 is inserted into the dishwasher chamber 11. Such insertion may be detected by any of various sensors 18*s*, such as a feeler that feels the dish being inserted, a photoelectric or optical detector, or optical detector, a detector detecting distortion of the doors 31 at the entrance 30, and so forth. The dish may be placed as to rest on the bottom support 61, and at step 84 the lift jack is lowered. At step 85 the water to wash or to rinse and then to wash a dish, or some other washing, rinsing, etc. function is turned on. For example, a valve 20*a* is opened by the controls 18 to allow water flow via the plenums 16 to the respective rotating nozzles 17, 17*a* to spray water against the dish 14. At step 85 the support 15 is rotated, for example, by input of the motor 65. The input may be provided by a gear train mechanism or the input may be provided by a belt drive connection or by some other mechanism to rotate the support 15. As the support 15 rotates, the rotating nozzles 17, 17*a* rotate with the respective of supports and also as water sprays out from the respective nozzles, the nozzles will rotate on their respective axis. Such rotation arrangement for the respective nozzles on their axis may be determined by the physical shape of the nozzles, the direction and shape of the orifices associated with the respective nozzles, and so on.

At step 87 the water flow and washing function are stopped, e.g., the controls 18 turn off or close the respective valves 20*a*.

Figure 2:
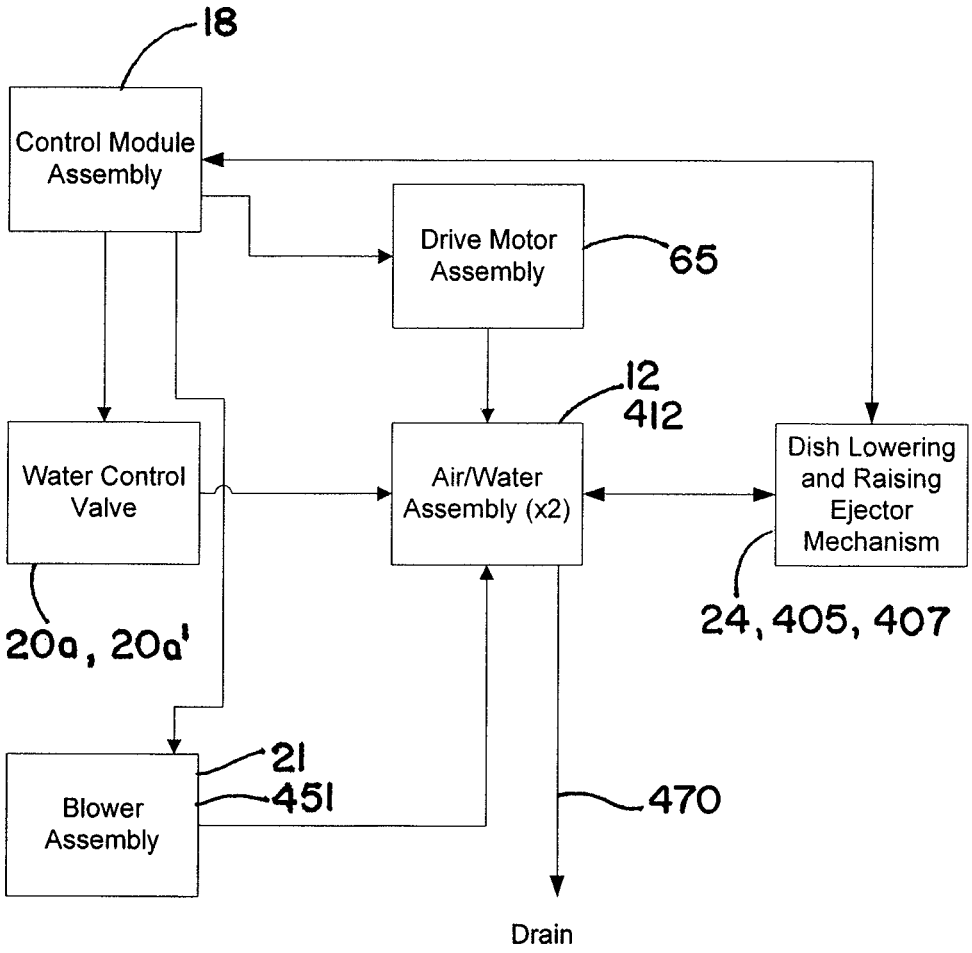
FIG. 2 is a schematic block diagram of several parts of the washing and drying apparatus of FIG. 1.

Drying then commences. At step 88 the air flow for drying is turned on. For example, the controls 18 turn on a blower 21 to provide air to the respective air plenums 41, 41*a* (FIG. 1). At step 89 the air outlet (also referred to as fluid outlet) 13, is moved to provide a spiral pattern of the air flow as it impinges against the surfaces of the dish from both fluid outlets 13, 13*a*. The spiral pattern, as was described above, is obtained by rotating the support 15 with respect to which the fluid outlet 13 is mounted, and the radial motion of the fluid outlet 13 along the slot 74 or other physical device that holds the fluid outlet to obtain motion in the direction of the arrow 75 (FIG. 2). At block 90 the drying is stopped, e.g., the controls 18 turn off the blower and stop rotating the support and radial motion of the fluid outlet 13. The fluid outlet 13 then may be retracted to the center location illustrated in FIG. 9, for example. The lift jack 23 then is operated to lift the dish upward (step 91) and out of the dishwasher through the entrance through the doors 31. The dish is removed at step 92.

Turning to FIGS. 11A-11G, and initially to FIG. 11A, an exploded isometric view of the dishwasher 10 is shown. The chamber 11 is made of two housing parts 11*a*, 11*b* forming between them the chamber 11 in which a dish may be washed. At the top of the dishwasher is the entrance 30, which may be an opening in the respective housing parts 11*a*, 11*b*. The respective doors 31 are attached to the housing parts by hinges 100. The air blowers 21 provide air to the dishwasher through a series of fittings and a rotary union 101. Two blowers 21 are illustrated, although air from one blower may be used for both sides of the dishwasher, e.g., to supply air to both dispensers 12, 12*a*. The air is blown through a fitting having a flow passage therethrough to the water air disc assembly 103 to deliver air from the blower to the fluid outlet 13. A series of seals and bearings and mounting plates generally illustrated at 104 about an opening 105 in the dishwasher housing parts 11*a*, 11*b* seal the flow path for the air from the blower 21 via the fittings and rotary union 101 to the fluid outlet 13.

Water is supplied to the plenum 16 that is within the water air disc assembly 103. The water is provided via water connections, tubing and the like generally indicated at 110. One solenoid valve 20*a* is illustrated that controls water flow to both of the plenums 16, 16*a*.

An exemplary germicidal ultraviolet lamp 36 is illustrated; as was mentioned above, there may be one or more of such lamps in the chamber 11, e.g., as is illustrated in FIG. 8A. Moreover, there also may be an infrared source, e.g., an infrared lamp, in the chamber 11, as was mentioned with respect to infrared lamp 54 schematically illustrated in FIG. 1.

An example of the lift jack 24 that is mounted in the chamber 11 is illustrated at the top center portion of FIG. 11A. The lift jack includes the bottom support 61, a bottom support plate 111, a basket 112, e.g., a wire basket or the like, guide rods 113, and a jack or lift mechanism 23. The jack 23 may be a hydraulic jack, a pneumatic jack, an electric motor with a screw member that screws in and out, or any other type of jack mechanism that may be controlled by the control 18, for example, and powered by an appropriate power source, e.g., electrical, pneumatic or hydraulic, and the jack 23 may lift or lower the basket 112 along the guide rails 113. For example, in the lifted position illustrated in FIG. 11A, a dish 14 may be placed in the basket 112; and then the jack 23 may be operated to lower the basket to place the dish in position in the chamber 11 to be washed and dried. After washing and drying, the jack 23 may be operated to lift the basket 112 to move the dish up toward the entrance 30 and through the doors 31 so that the dish may be manually grasped and removed from the basket 112. Preferably the basket is in raised condition when a dish is placed through the doors 31 and entrance 30 into the basket 112; then the basket is lowered for washing and drying of the dish; and then the basket is raised for removal of the dish after washing and drying. The basket may be any type, but in an embodiment is a screen-like basket having a number of guide parts to hold the dish within the basket or to stabilize the dish in the basket, e.g., as the stabilizers 62 mentioned above with respect to FIG. 1. The basket 112 is sufficiently open to allow washing liquid and drying air to wash and dry the dish, respectively. Also, the basket may be sufficiently open to allow ultraviolet or germicidal effect directed at the dish and/or infrared energy to warm the dish.

To rotate the respective water air disc assemblies 103, a gear motor assembly 115 may be operated by the controls 50 to cause gear teeth 115*g* on the gear motor assembly to interact with gear teeth 116 on the support 15 of the water air disc assembly 103 to cause rotation in one direction or the other about the axis A, as was mentioned above.

FIG. 11A shows a drive belt mechanism 120, 120*a* used to turn the respective water/air disc assemblies. The drive belt mechanism includes a respective motor 120*m*, one for each water/air disc assembly 103, 103', a drive belt 121, and appropriate gear teeth about the water/air disc assembly for mating with teeth in the drive belt. An advantage to having teeth interaction between the belt and the water/air disc assembly 103 is to avoid slippage as the belt 121 is moved by the motor 120 to turn the water/air disc assembly. A gear assembly may be used instead of the drive belt mechanism to provide connection of the motors 120*m* to the disc assemblies 103, 103'.

The motors 120*m* may be electric motors or they may be hydraulic or pneumatic motors. An advantage to hydraulic motors is that they may be operated using water pressure from a typical water faucet or other home plumbing system, etc., and water to those hydraulic motors may be controlled by the controls 18 and appropriate solenoids, valves or the like.

Figure 11B:
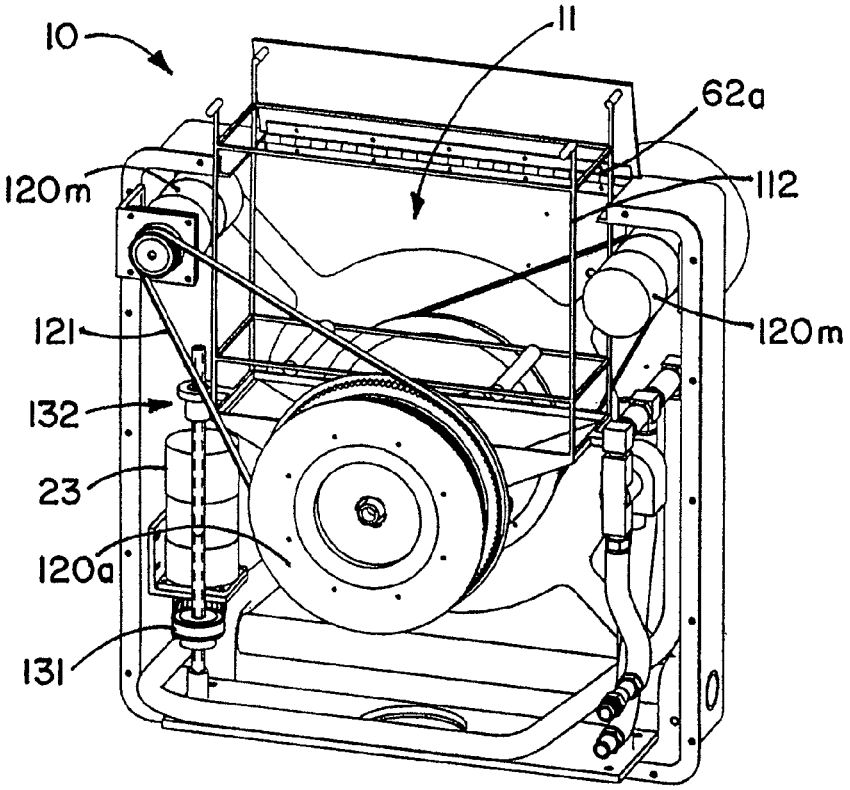
FIGS. 11B-11G are views of the dishwasher of FIG. 11A.

As is illustrated in FIG. 11B, motor 23 may be used to turn a belt 131 that in turn is connected to a nut and screw member (or ball, nut and screw member) 132 of a modified lift jack mechanism 21. Turning of the motor 130 under a control by the controls 50, for example, may turn the screw 132 or a ball in one direction or the other to raise or to lower the basket 112. The screw 132 may be coupled to a threaded fitting at the basket 112 and may be mounted with respect to the support plate 61 of the lift jack assembly 24. The controls 18 may operate the motor 23, which may be a hydraulic motor, pneumatic motor or electric motor, e.g., as was mentioned above with respect to the motors 120*m*, and the motor may rotate the belt 131 to turn the screw 132 to raise or to lower the basket 112.

Figure 11C:
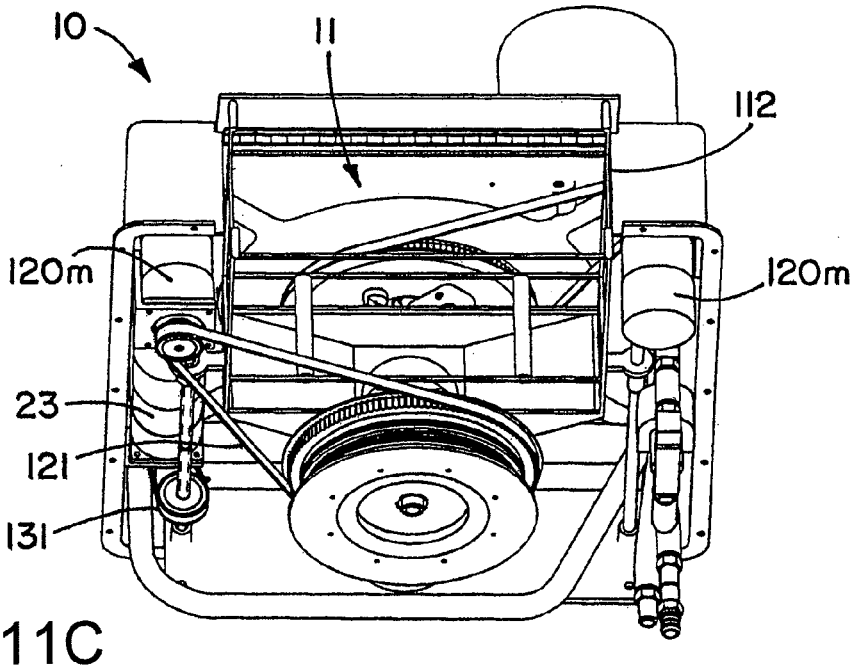

FIGS. 11B and 11C are isometric vies of the inside of the dishwasher chamber 11 of the dishwasher 10 shown in FIG. 11A. The drive belts 121, drive motors 120M and associated drive pulleys 120*a* are shown water/air disc assembly 103.

Figure 11D:
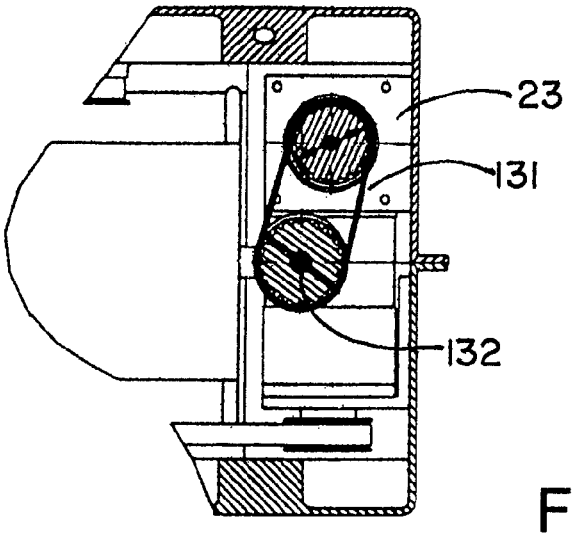

FIG. 11D illustrates the belt drive including a drive motor 130, belt 131 and drive screw 132 of the lift jack mechanism 24 of FIG. 11A.

Figure 11E:
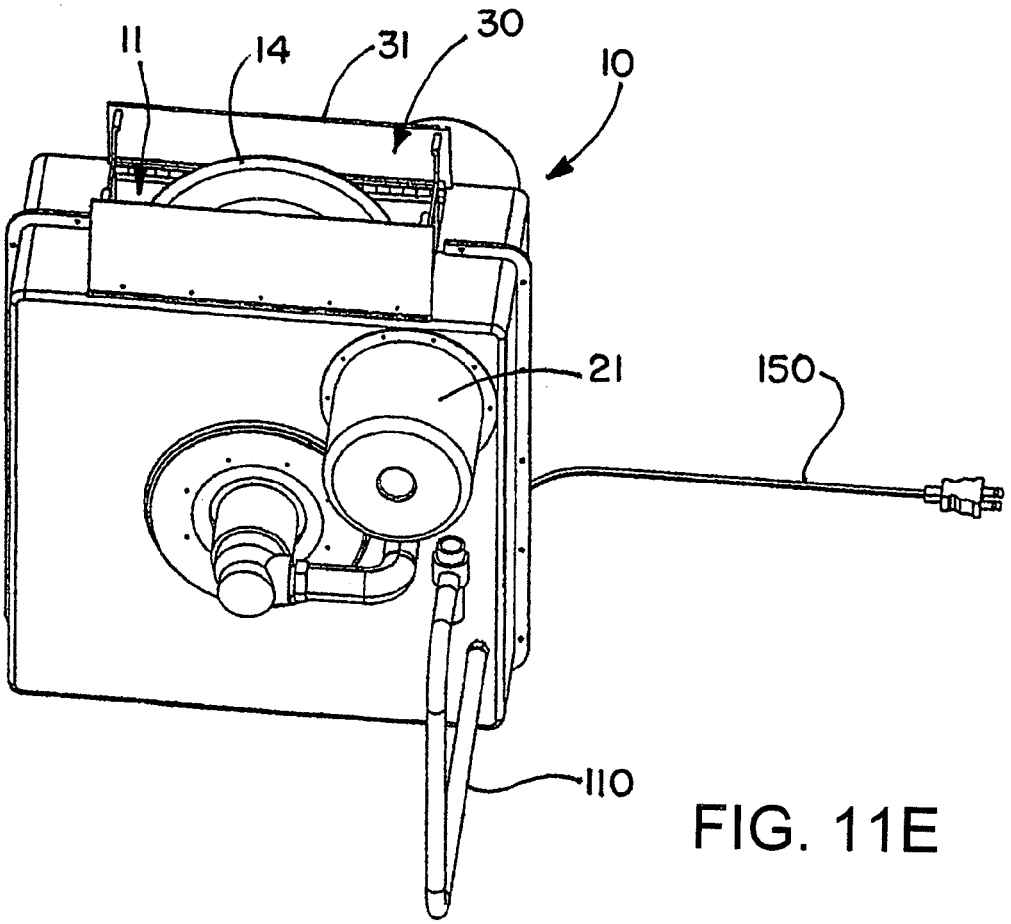
Figure 11F:
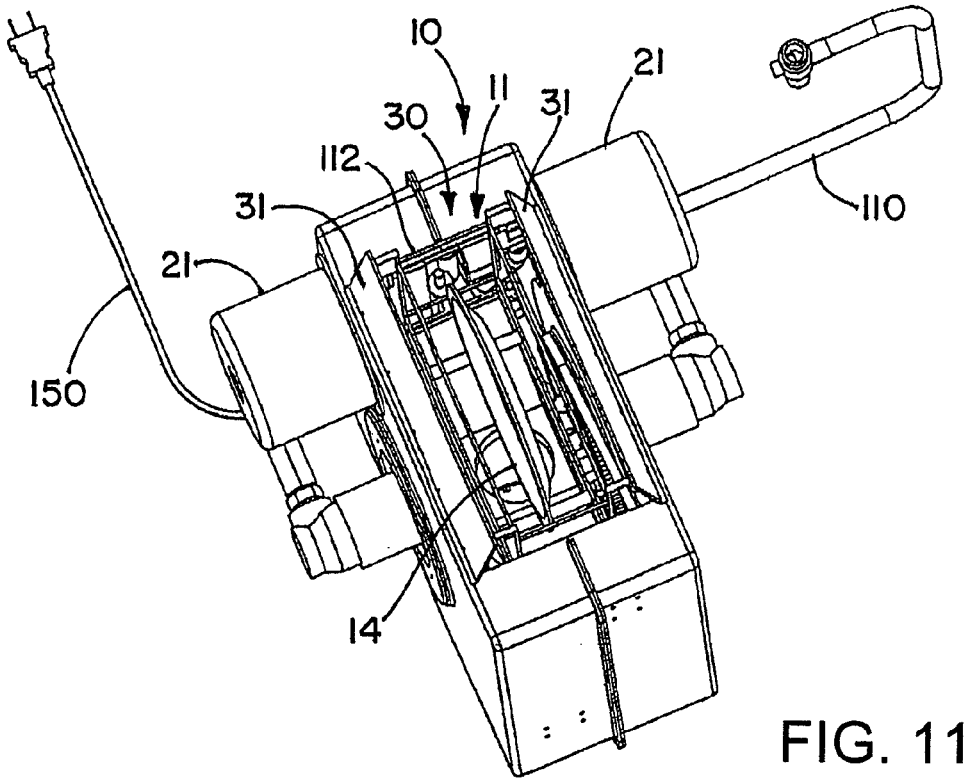
Figure 11G:
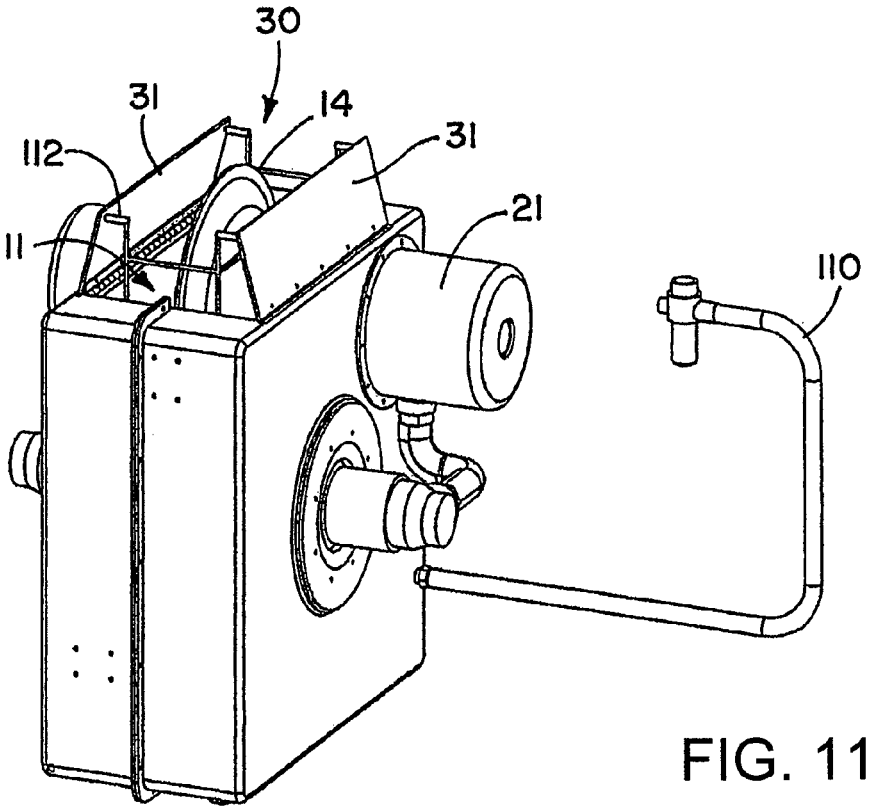

FIGS. 11E, 11F and 11G are respective isometric views of the dishwasher 10 of FIG. 11A. A water supply tube 110 is shown. Also shown is an electrical power cord 150 to connect with a source of electrical power to supply electrical power to the dishwasher 10. The source of electrical power may be the local utility company, a battery, etc. The electrical power may be provide, for example, to the controls to allow the controls to be operated and to work to carry out various functions, such as those described herein and/or other functions. The controls also may distribute electrical power it receives to various parts of the dishwasher, as needed, such as, for example, to motors, to the UV and/or IR sources 36, 54, to the heater of the heater/water supply 20, and so on.

Figure 12:
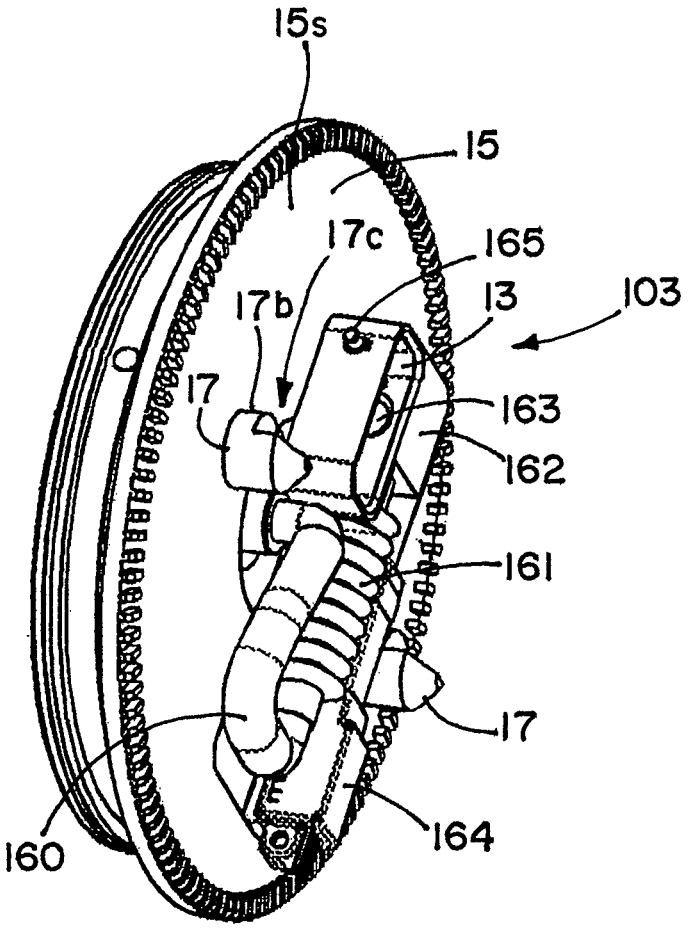
FIG. 12 is an isometric view of a water air disc assembly including fluid outlet that is movable in a linear reciprocating manner with respect to the support while the support itself rotates.

Referring briefly to FIG. 12, an embodiment of water/air disc assembly 103 is illustrated. On the support 15 of the assembly 103 the rotating nozzles 17 are mounted. The nozzles 17 are mounted so they can rotate about an axis B (FIG. 9) that is generally perpendicular to the support. The shape of the nozzles 17 is such that they have a generally circular or oval base 17*b* and a cutout area 17*c*. The orifice(s) 70 from which water is dispersed (FIG. 9) are configured in position and shape such that water forced therethrough causes a reaction force to cause the nozzles 17 to rotate about their respective axes. As the support 15 is rotated with the water/air disc assembly 103, the nozzles are carried by the support 15 and spray water on a dish 14 in the chamber 11.

The fluid outlet 13 is the discharge opening from which air is blown toward a dish 14 to dry the dish. A tubular system 160 provides flowing air (blown air), which is received from the blower 21 via the rotary union 101 and fittings, and plenum 41, through a flexible or extensible (extendible and contractible) tube 161 to the fluid outlet 13. The flexible tube 161 provides the air flow into a small housing or plenum 162, which opens at 163 into the fluid outlet 13. Air is blown from the fluid outlet toward a dish 14.

A motive device 164, such as, for example, a bayonet—like sliding device is attached to the support 15 and receives a mechanical input to push or to pull the plenum 162 and fluid outlet 13 generally linearly along a direction parallel to the surface of the support 15. The motive device 164 may be attached to the support 15 and also may be attached by a pin, rivet, screw, bolt or other fastener 165 to the plenum 162 and/or to a wall of the fluid outlet 13. The motive device 164 may include a solenoid or a fluid motor that responds to electrical or fluid input, respectively, to extend or to retract the motive device to move the plenum 162 and the fluid outlet 13 along a direction that is generally linear and generally parallel to the surface of the support 15. Other types of motive devices may be used to move the outlet 13 generally linearly as described, stretching or extending the flexible tube 161 and retracting the flexible tube 161 to withdraw the fluid outlet from its extended position. Operation of the support 15 and of the overall water/air disc assembly 103 in rotation may be controlled by the controls 18.

A slot or a groove 74 (FIG. 9) in the surface 15*s* of the support 15 may provide for guiding the fluid outlet 13 in accordance with the above-described motion.

Operation of the motive device 164 may be controlled by the controls 18.

In operation of the dishwasher 10 for drying a dish 14, the fluid outlet 13 is in its retracted location or position generally as is illustrated in FIGS. 9 and 12. Drying air is turned on by the controls, e.g., the blower 21 is turned on. Drying air flows out from the fluid outlet 13 toward the surface of dish 14. The water/air disc assembly 103 is rotated, and at the same time the motive device 164 extends its bayonet assembly to move the fluid outlet generally linearly along the surface of the support 15. The flexible/extensible tube 161 stretches to continue to direct air flow to the plenum 162 and the air exits the fluid outlet 13. The pattern the air makes on the dish is generally a spiral pattern that tends to push water that is on the surface of the dish toward the perimeter of the dish and then off from the dish at the perimeter. The spiral pattern tends to blow water off the edge of the dish at the perimeter solving this problem.

The aforesaid operation may be carried out several times, if desired. For example, after the fluid outlet 13 has been moved to its furthest location generally radially away from a generally central location relative to the surface of the support, the fluid outlet may be retracted and the process of blowing water from the surface of the dish may be repeated again. It will be appreciated that the actual location of the tubes 160, 161, outlet 13 and motive device 164 need not be precisely as illustrated. However, the illustration is provided by way of example. It will be appreciated, though, that by linearly moving the fluid outlet 13 while the water/air disc assembly is rotated tends to create the desired described generally spiral pattern.

Also, it will be appreciated that the water air disc assembly 103 may be rotated generally continuously in one direction during the aforesaid washing and/or drying operation or on multiple directions; or it may be rotated in a reciprocal fashion back and forth relative to the illustrated arrow.

Moreover, it will be appreciated that the pattern described need not be a precise spiral. Other orientations of the members 160-165 and fluid outlet 13 relative to the water/air disc assembly 103 support 15 may be used to achieve various, but similar operation as described. Further, the motion of the fluid outlet 13 may be generally uniform, constant speed or it may be staggered in a somewhat staccato fashion moving a bit, stopping, moving more, stopping, and so on so as to achieve a desired drying operation and energy efficiency.

Figure 15:
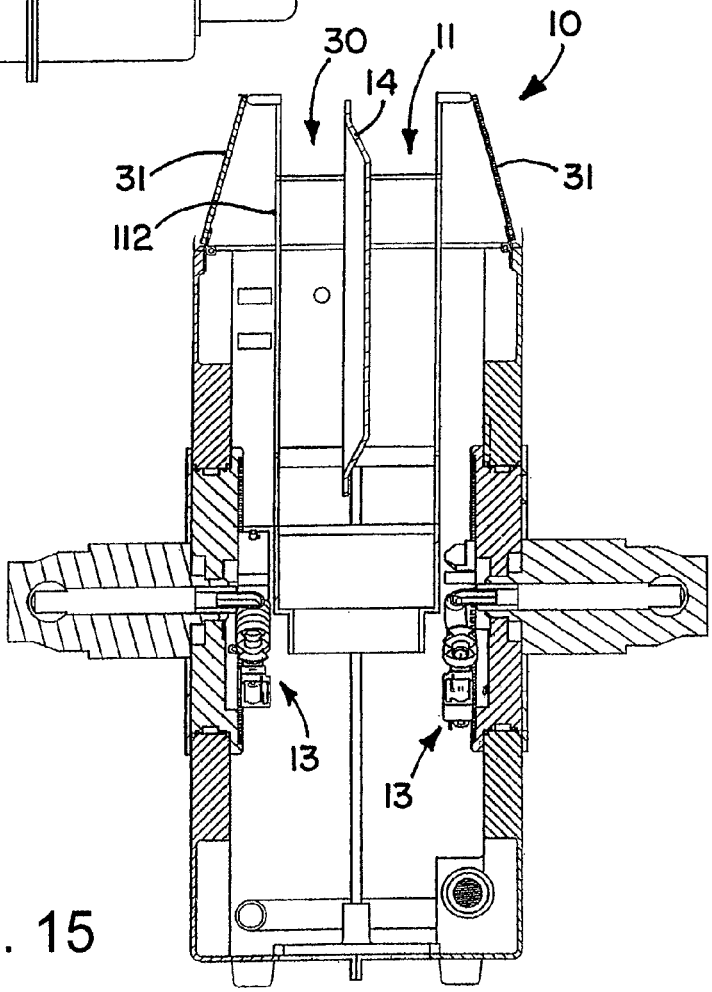
FIG. 15 is a side elevation section view of the dishwasher with a dish part way inserted therein by the support or lift jack mechanism.
Figure 16:
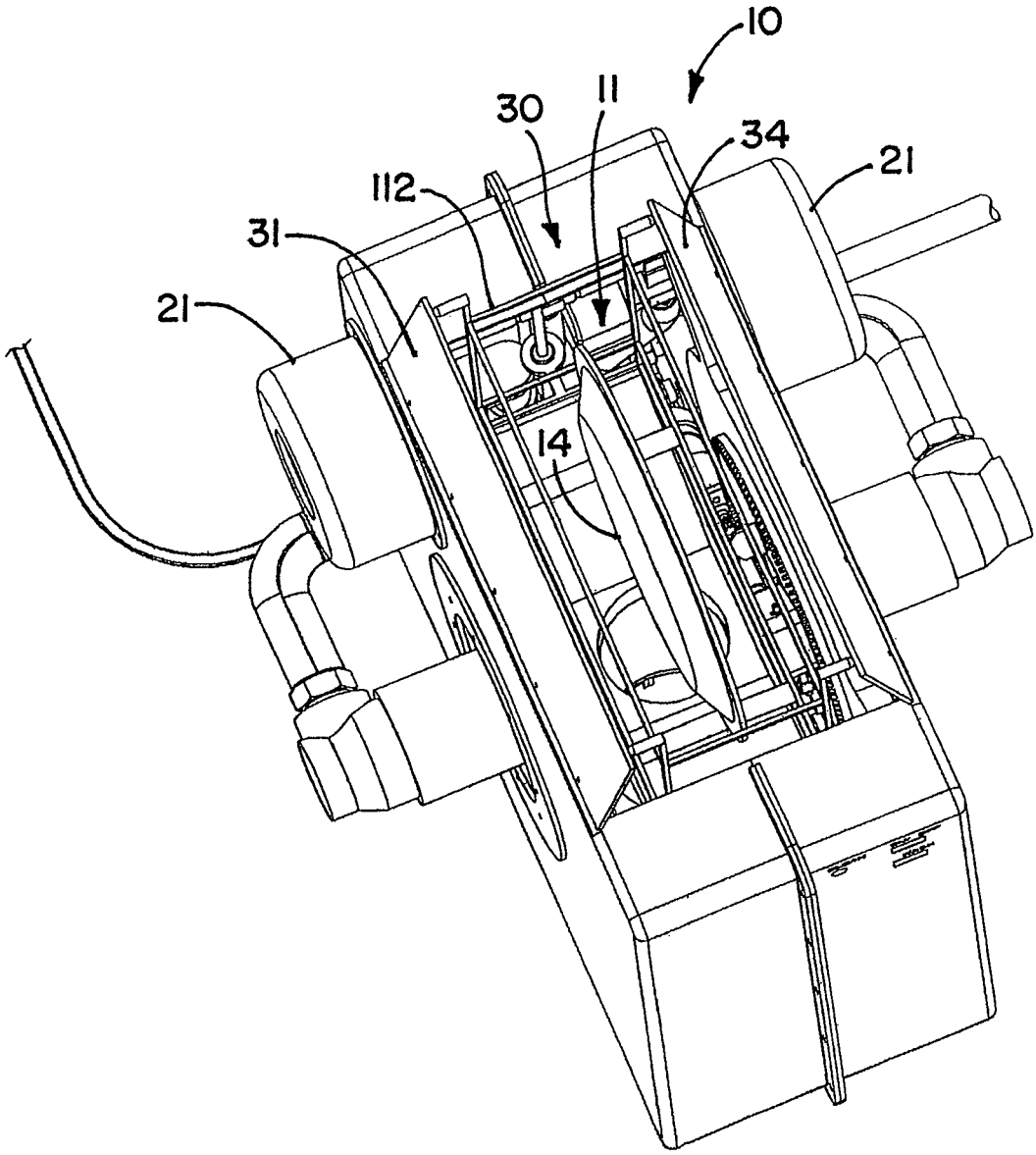
FIG. 16 is a top isometric view looking down into the dishwasher with the entrance opening at the top of the dishwasher having the respective door/flanges open to show a dish part way entering or being raised for removal from the dish washing chamber.
Figure 17:
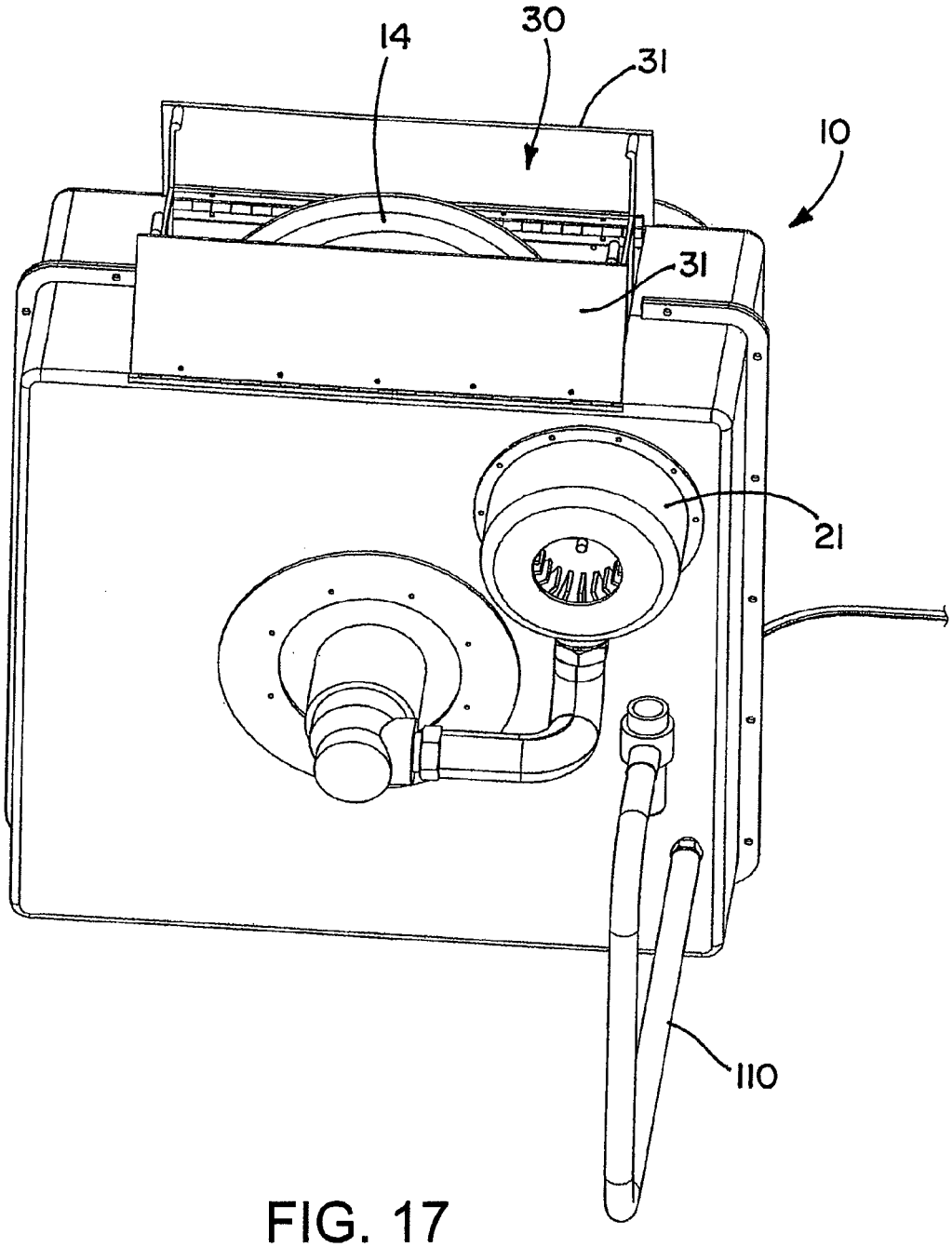
FIG. 17 is a side elevation isometric view of the dishwasher of FIG. 9.
Figure 18:
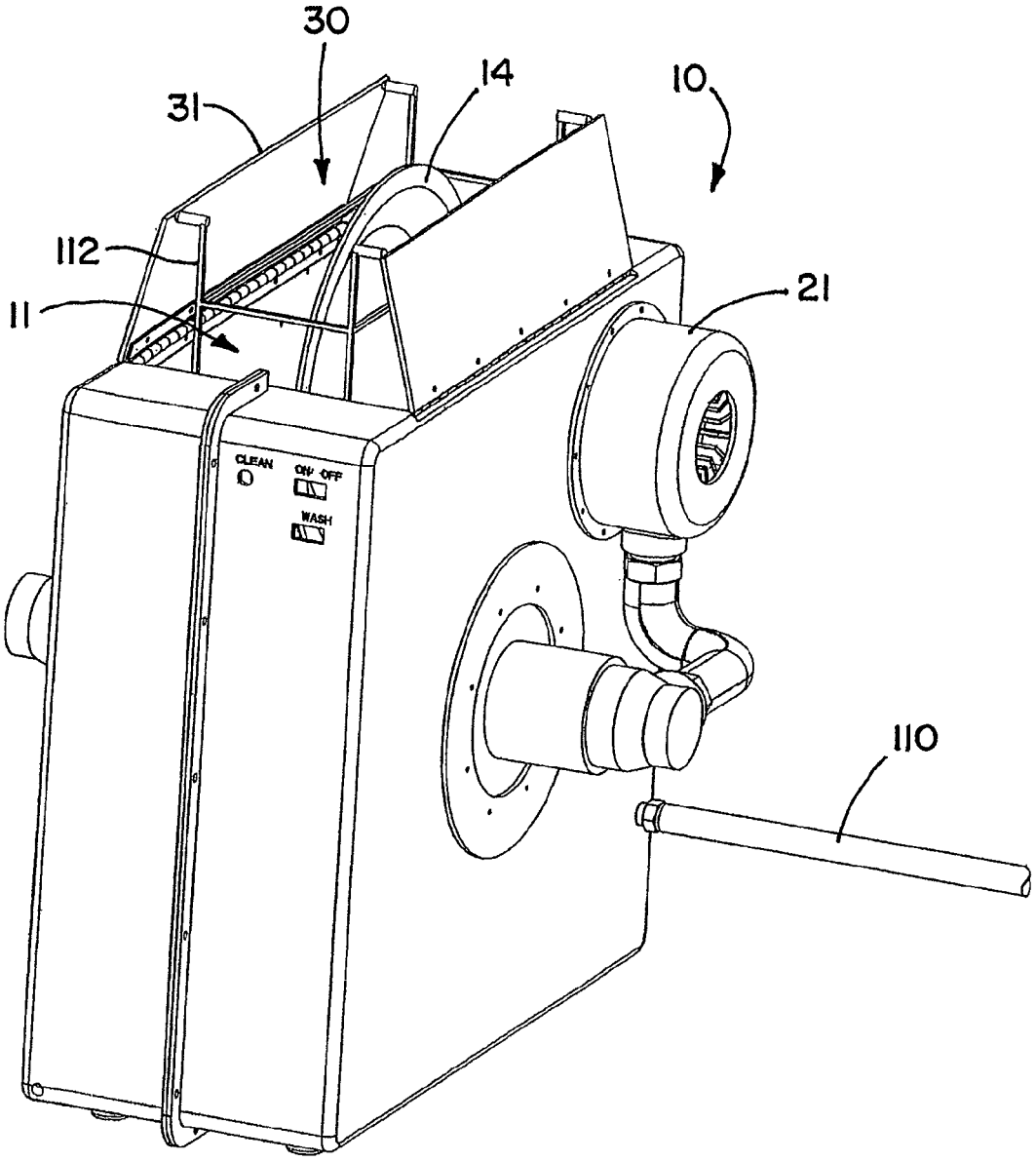
FIG. 18 is a front isometric view of the dishwasher with the entrance door flaps or flanges open and a dish part way inserted or raised for removal from the dishwashing chamber.

FIGS. 13-18 illustrate further assembled and partially assembled views of the dishwasher 10 looking from different directions. FIG. 13 is an end side isometric view showing a dish having been placed in the basket 112 either getting ready to be washed or having been washed getting ready to remove. FIG. 14 is a top plan view similar to the arrangement and condition illustrated in FIG. 13. FIG. 15 is a side elevation section view, partly in section, of the dishwasher generally in the arrangement and condition illustrated in FIG. 13. FIG. 16 is a top isometric view of the dishwasher in the arrangement and condition illustrated in FIG. 13. FIG. 17 is a front side isometric view and FIG. 18 is an end side isometric view of the dishwasher 10 in the arrangement and condition illustrated in FIG. 13.

Figure 19:
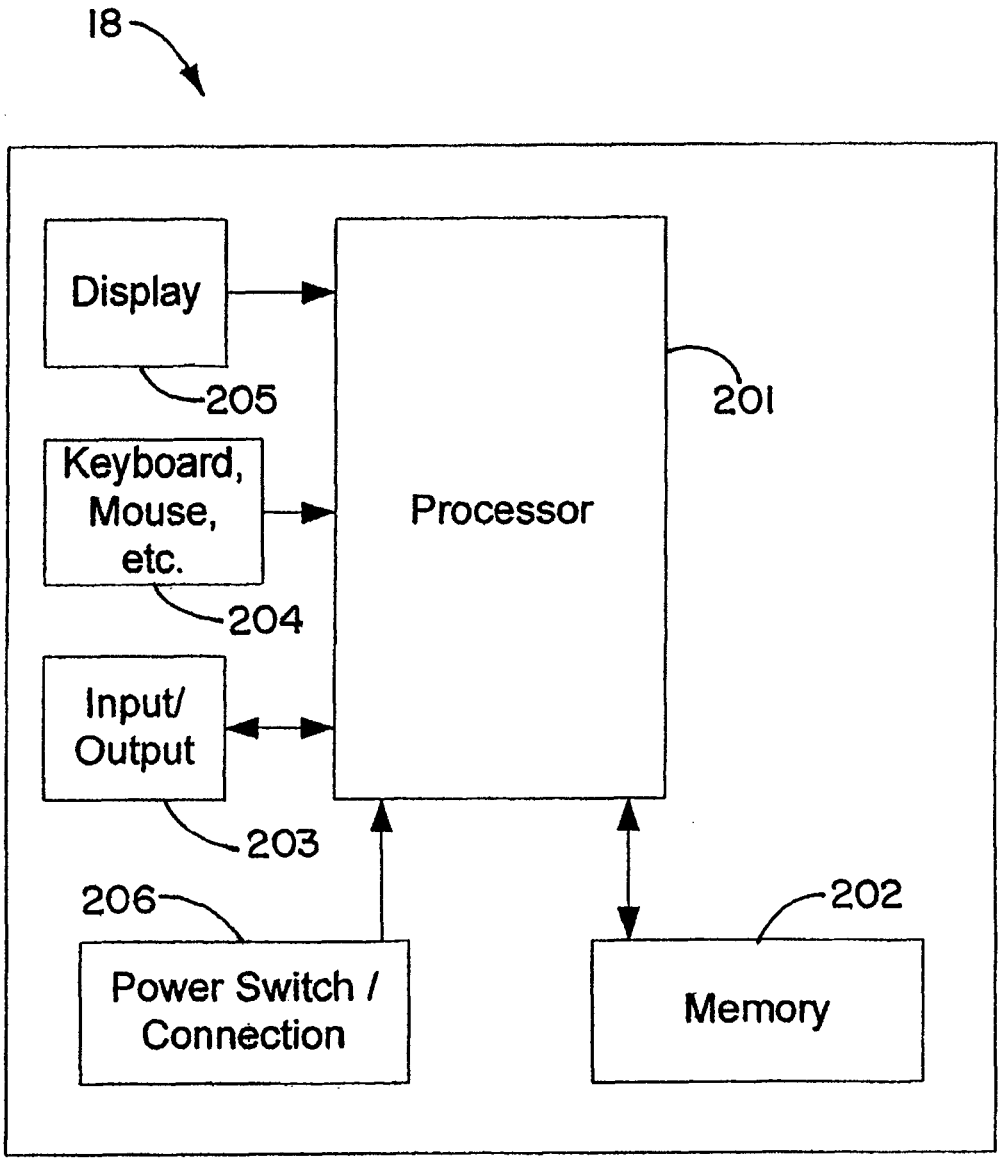
FIG. 19 is a schematic illustration of a control circuit for controlling operation of the dishwasher.

FIG. 19 illustrates schematically controls 18 for the dishwasher 10. The controls includes a processor 201, memory 202, input/output 203, keyboard, mouse, etc. 204 and display 205. Also, a power switch connection 206, e.g., to receive electrical power from the power cord 150, is provided. Appropriate computer program software may be stored in a non-transitory memory 202 to provide for operation of the various valves, motors, light sources, etc., described above in the manner described above. The input/output may provide for manual control inputs; and also may provide for inputs from the various sensors or the like. The input/output also provides outputs to operate various parts of the dishwasher system 10. Furthermore, the keyboard, mouse, etc., may be used to allow a user to provide inputs to the controls 18. Further the display may show current operation and/or other information associated with the dishwasher 10 and its operation.

Referring to FIG. 20, a hand washing and/or drying system 300 is illustrated. The system 300 may include two separate units 310, 311 the same as or similar to the dishwasher 10. For only drying hands, the units 310, 311 may include a sensor 18*s* to sense that a person has inserted his/her hands into the entrance 30 thereby to start the spiral air flow to dry the hands as described above. The spiral air flow may have a more efficient drying effect than the air flow experienced in conventional hand driers. If the units 310, 311 are to provide both washing and drying functions, the sensor may sense inserting of respective hands and cause washing in each of the units in a manner similar to that described above with respect to the dishwasher 10. There is no need for a continuous water flow from a water faucet at a sink, which would waste water. There is controlled distribution of water and also of soap, if used. There also is the possibility for warming and for disinfecting using the sources 54, 36. Automatically the drying function begins in the manner described above, whereby after sufficient washing time has occurred, the drying begins. Thus, it will be appreciated that the washing and drying can be carried out quite efficiently, e.g., saving power and water; and there is no need for the person who is washing hands to touch any objects, e.g., soap dispenser, water faucet, paper towel dispenser, and so on.

The various times for operation of the dishwasher 10 and the units 310, 311 may be varied, as desired. An example of timing may be from as little as several, e.g., 2 to 5 seconds for each operation of washing and for drying, e.g., a total of from about four seconds to ten seconds for complete washing and drying operation may be used. Other timing also may be used.

FIG. 21 also illustrates a hand washing and drying system 310', which is similar to the washing and drying system 310 except it includes only one washing and drying chamber 11 one pair of assemblies 12, 12*a* (see FIG. 8A); and it includes a separator wall 32 dividing the chamber 11 in two parts 11L, 11R, one for each hand. Openings 33 in the top wall of the system 310' are for respective hands to be inserted into the respective chamber parts 11L, 11R. If desired, the wall 32 may be omitted and only one chamber 11 provided. A user would insert hands into openings 33 and the system 310' would wash and dry the hands, as is described above.

Figure 8B:
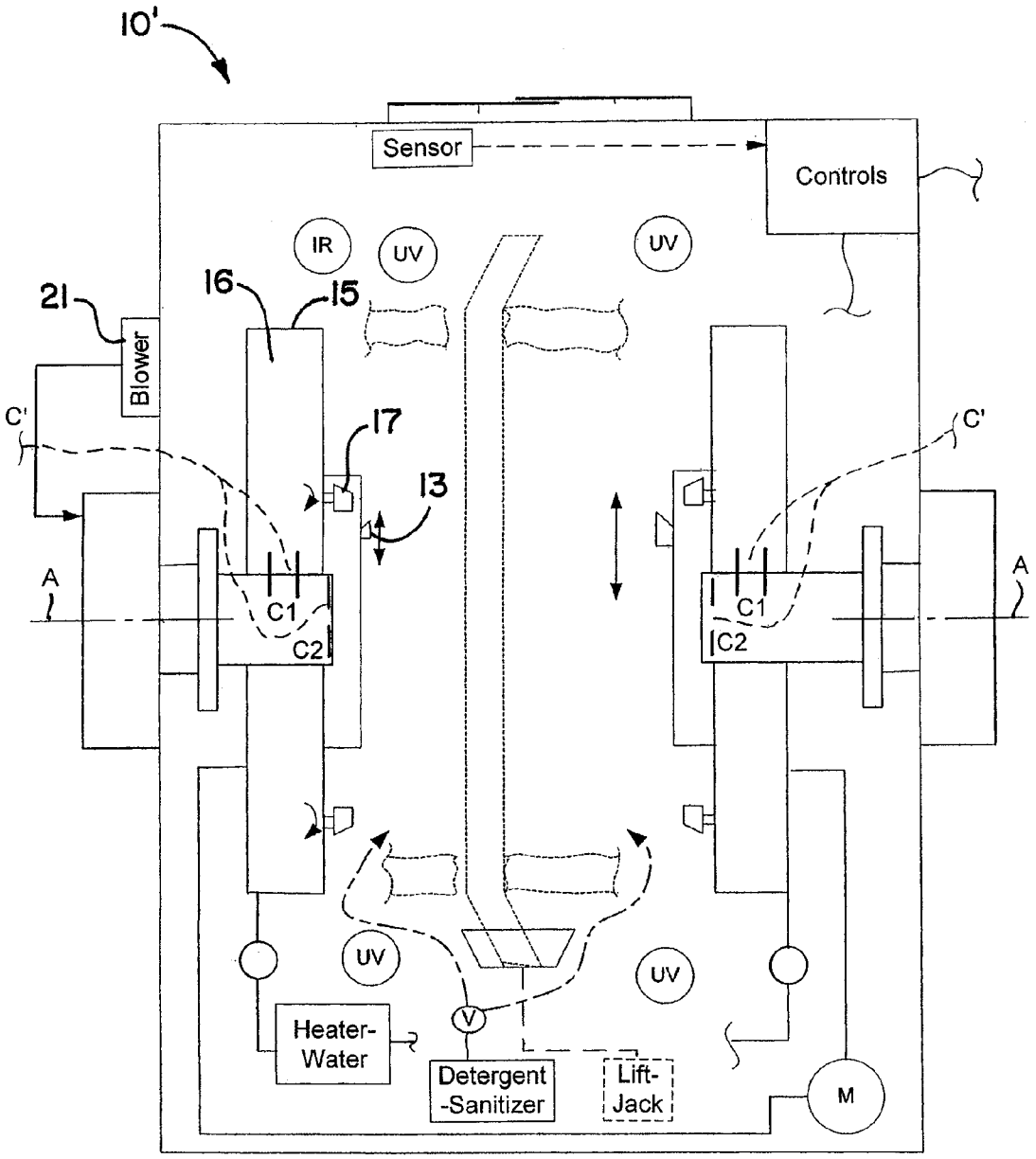
FIG. 8B and FIG. 8C, which are described near the end of this specification, are schematic illustrations of other illustrative embodiments of dishwashers similar to the dishwasher of FIG. 1 and of other figures hereof, but also providing for the combining of both water and air for washing.
Figure 8C:
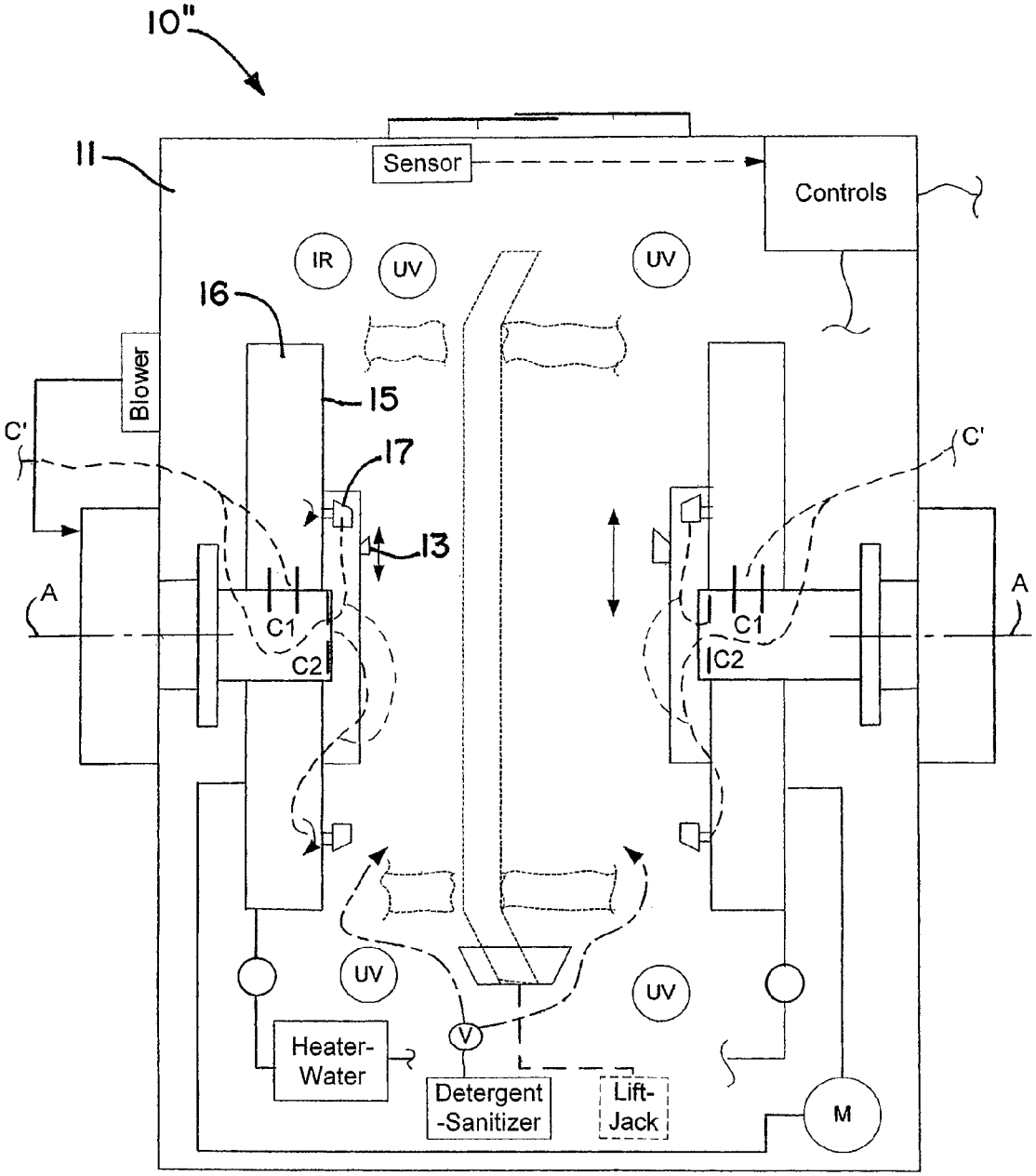

FIGS. 8B and 8C, illustrate illustrative embodiments of dishwasher 10', 10" that provide for improved ecological operation and structure over the dishwasher 10 described above. In the dishwashers 10', 10" of FIGS. 8B and 8C air and water are used for washing. This combined use of air and water that are directed together, e.g., as a mix, toward a dish in the dishwashing chamber tends to reduce the amount of water needed to wash dishes. The use of air in combination with the water tends to add energy to the process, e.g., to increase the energy of the flow of fluid to and against a dish being washed, which tends to lead to faster and more complete cleaning of a dish being washed. The addition of air to water will provide for greater ecologic efficiency (less water), faster cleaning and better cleaning.

Turning to FIG. 8B, In the dishwasher 10' several operational options are provided. One of those operational modes provides for combining air and water for use in the washing function. Thus, an opening C1 (together with appropriate valving) in the air flow structure may be open all the time or may be opened under control of an appropriate signal provided from a connection C', e.g., from controls 18 that may control an appropriate valving included at the opening C1 to provide air to the water in the plenum (reservoir) 16. The air may be provided from the blower or from another source. The air may be combined with the water in the water plenum or reservoir. The air may be combined with the water at the spray nozzles 17 from which the mix is directed toward a dish in the washing chamber. Or, the air and water may be mixed elsewhere such that the water and air mix flowing against a dish may have a greater force of impact and/or scrubbing action against the dish and food or dirt on the dish to enhance the washing of the dish cleaning it of food, dirt or the like.

Another opening C2 with appropriate valving may be provided in the air flow path along which air is provided for drying a dish. The opening C2 may be operated in response to signals provided from connection C', e.g., from controls 18. Operation, e.g., opening and controlling of the opening C2, may be coordinated by the controls 18 so that the opening C2 is closed when air is directed to the plenum or reservoir 16 and/or while a dish is being washed, and, therefore, at that time the air is not directed toward the dish for drying. However, when it is desired to dry a dish, the opening C2 would be opened so that air is directed toward a dish for drying it. During drying the opening C1 may be closed to avoid loss of air flow from the drying flow path.

FIG. 8C shows another illustrative embodiment of dishwasher 10*a*. In the dishwasher 10" shown in FIG. 8C one of the two flow paths for washing or for drying a dish in the dish washing chamber 11 may be eliminated. For example, nozzles 17 may be used to deliver water for washing and also air for drying. The above-discussed drying flow path may be eliminated, if desired. The valving C1 and C2 and openings associated therewith may be operated by signals provided at connection C' from the controls 18 in this embodiment so that air may be provided the water plenum/reservoir 16 for washing, as was described above, and then air maybe provided for drying. However, in this embodiment the water and air combination for washing is provided out through the nozzles 17; and also the air provided for drying also is provided through the nozzles 17; in both cases the nozzles direct the fluid flow (water and air combination or air) into the dish washing chamber 11 for washing and for drying. A flow path for the air from the blower to the nozzles 17 is shown for use in drying and, thus, avoiding flow of the air into the water plenum/reservoir 16. The form factor of the nozzles 17 may be different in this embodiment from the form factor if used only for washing. For example, the size and shape of the outlet opening(s) from the nozzles may be larger or smaller, different shape, differently directed angularly, and so on. Also, the number of nozzles 17 may be increased or decreased, as may be desired.

Some features and summaries:

A. A dishwasher comprising a fluid dispenser for washing a dish in a washing chamber, a source of water and a source of air, and a dispenser for directing fluid including both water and air to was a dish in the washing chamber.

B. The dishwasher comprising a plenum or reservoir containing a liquid for washing a dish, and a flow path coupled to receive air and to direct the air into the plenum or reservoir for use with the water to wash a dish.

C. The dishwasher further comprising a nozzle for directing a combination of air and water in the washing chamber to wash a dish therein.

D. The dishwasher further comprising a drier for directing air to a dish in the washing chamber to dry the dish.

E. The dishwasher wherein comprising a combination nozzle to control the flow of fluid to wash a dish and to dry the dish in the washing chamber, wherein the same nozzle is used to direct washing fluid and drying air to the washing chamber respectively to wash and to dry a dish.

F. The dishwasher wherein the washing fluid is a combination of air and water.

G. The dishwasher wherein the mix of water and air directed to the washing chamber to wash a dish has increased energy compared to only washing with water.

H. The dishwasher wherein the washing chamber is of a size and shape to contain one dish at a time for washing and drying of the dish.

I. The dishwasher further comprising a control configured to control the flow of fluid to the washing chamber to wash and to dry a dish therein.

J. The dishwasher further comprising a valve control configured to control the shape and size of the nozzle through which air and water are directed to a dish in the washing chamber for washing the dish and through which air is directed to the dish for drying the dish.

K. A method of washing a dish, comprising directing a flow of water and air toward a dish to wash the dish.

L. The method further comprising directing a flow of air toward a dish to dry the dish.

M. The method comprising directing of the combination of air and water to wash a dish and for directing air to dry the dish comprises delivering the fluid through the same nozzle.

N. The method comprising directing of the combination of air and water to wash a dish and for directing air to dry the dish comprises delivering the fluid through different nozzles.

s1. A fluid dispenser, comprising a rotatable support, a fluid outlet movably mounted with respect to the support and configured to permit fluid flow out from the fluid outlet, wherein the fluid outlet is movable with the support during rotation of the support and is movable with respect to the support during rotation of the support to tend to direct fluid out from the fluid outlet in a generally spiral path.

s2. The dispenser wherein the support comprises a generally circular surface.

s3. The dispenser further comprising a plenum and wherein the support comprises a wall of the plenum.

s4. The dispenser further comprising a space facing the support and fluid outlet, and wherein the fluid outlet and support are cooperatively configured to direct a generally spiral flow of fluid into the space.

s5. The dispenser further comprising a motive device configured to move the fluid outlet generally in a linear path along generally in parallel with a surface of the support.

s6. The dispenser wherein the motive device is configured to move the fluid outlet in a reciprocating motion.

s7. The dispenser further comprising a motor configured to rotate the rotatable support.

s8. The dispenser wherein the motor is an electric motor.

s9. The dispenser wherein the motor is a fluid motor.

s10. The dispenser wherein the motor is configured to reciprocate the support rotating it generally about its axis in opposite directions.

s11. The dispenser wherein the fluid outlet includes a hose.

s12. The dispenser further comprising a fluid source coupled to deliver fluid to the fluid outlet.

s13. The dispenser wherein the fluid is a gas.

s14. The dispenser wherein the fluid is air.

s15. The dispenser further comprising a holder for holding an object to be dried, and wherein the fluid outlet is directed toward the area of an object held by the holder to provide fluid in against such object in a generally spiral path tending in a manner tending to dry a wet object.

s16. The dispenser further comprising liquid outlets configured to spray a liquid against an object.

s17. The dispenser wherein the fluid outlet and support are configured to direct a flow of gas toward such object in a manner to dry the object.

s18. The dispenser wherein the liquid is water to wash the object and the outlet is configured to direct a flow of air to dry the object.

s19. The dispenser wherein the support comprises a plenum or reservoir containing a liquid to wash an object, and further comprising spray nozzles coupled to receive liquid from the plenum or reservoir to spray an object for washing.

s20. The dispenser wherein the support is rotatable about an axis and the nozzles rotate on respective axes that are relative fixed with respect to the support and the outlet is movable in a direction generally parallel with a surface of the support.

s21. The dispenser further comprising a control configured to control flow of liquid from the nozzles for washing an object, to stop the flow of liquid, and to commence the flow of fluid from the fluid outlet to dry the washed object.

s22. The dispenser further comprising a housing or casing holding the support and fluid outlet.

s23. The dispenser further comprising a source of ultraviolet radiation configured to provide ultraviolet radiation in the housing or casing for disinfecting.

s24. The dispenser further comprising a source of detergent configured to dispense detergent for washing an object exposed to the dispenser.

s25. The dispenser further comprising a drive configured to move the support and the fluid outlet in respective reciprocating paths.

s26. The dispenser further comprising a slot in the support, and the outlet movable along the slot to deliver output fluid in a generally spiral pattern as the outlet is moved along the slot while the support is rotating.

s27. The dispenser further comprising a connection to a source of water for washing an object.

s28. The dispenser further comprising a blower configured to supply a source of air flow for distribution out from the fluid outlet.

s29. A dishwasher comprising a housing, the dispenser of any of claims 1-28 in the housing, an entrance for placing one dish at a time into the housing in exposure to be washed and dried by the dispenser.

s30. The dishwasher further comprising a support configured to hold a dish in position relative to the dispenser for washing and drying of the dish.

s31. The dishwasher the support comprising a jack configured to lower one dish at a time into the housing in position to be washed and dried by the dispenser and to lift the dish to the entrance for removal of the dish.

s32. A fluid dispenser, comprising a fluid outlet, a rotatable support, a slot in the rotatable support, the fluid outlet being movable in the slot while the rotatable support rotates, whereby the fluid outlet traverses a spiral path as it moves along the slot while the support rotates.

s33. The fluid dispenser wherein the support can rotate continuously or back and forth (reciprocally) clockwise/counterclockwise.

s34. The fluid dispenser wherein the fluid outlet can move back and forth in the slot.

s35. The fluid dispenser wherein the fluid from the fluid outlet is provided in a spiral impinging pattern.

s36. The fluid dispenser further comprising a hose coupled to supply fluid to the fluid outlet.

s37. The fluid dispenser wherein the fluid is air.

s38. The fluid dispenser wherein the fluid outlet slides in the slot.

s39. The fluid dispenser further comprising a mounting structure for fluid outlet s40. The fluid dispenser wherein the support is a plenum containing fluid.

s41. The fluid dispenser further comprising nozzles fluidically coupled to receive fluid from the plenum and rotatable with the support; and wherein the nozzles rotate with the rotation of the support.

s42. The fluid dispenser further comprising a control to sequence distributing of air and water from respective fluid outlet and nozzles.

s43. The fluid dispenser further comprising a dispenser for dispensing soap or other cleaning agent and/or disinfecting agent.

s44. The fluid dispenser wherein the soap, cleaning agent or disinfecting agent is a liquid.

s45. A dishwasher comprising the dispenser of any of claims 1-44.

s46. The dishwasher further a housing containing at least part of the dispenser, and a wash area in the housing where a dish may be washed by washing fluid from nozzles and dried by air from the fluid outlet that is provided in a spiral pattern against a surface of the dish.

s47. The dishwasher further comprising an entrance into the wash area in the housing configured to receive one dish at a time for washing and drying.

s48. A method of washing a dish comprising directing washing fluid against a surface of a dish, and directing a flow of gas at the dish to impinge on a surface of the dish in a generally spiral pattern.

s49. The method comprising washing one dish at a time.

s50. The method comprising placing one dish at a time into a dishwasher housing, washing and drying the dish, and removing the dish from the dishwasher housing.

s51. A hand washer comprising two areas or two dispensers as set forth above, one for each hand and operable to wash and dry both hands simultaneously.

s52. A method of washing and drying hands comprising placing the hands in a hand washer above and automatically operating the hand washer to wash and dry both hands simultaneously.

The invention claimed is:

1. A washing and drying apparatus, comprising a housing, a chamber in the housing, a washing fluid dispenser configured to direct a spray of washing fluid to an object in the chamber to wash the object, and a drying fluid dispenser configured to direct a flow of drying fluid at an object in the chamber to dry the object, wherein the drying fluid dispenser includes an outlet that undergoes spiral motion to direct the flow of drying fluid toward the object while moving the flow of drying fluid in a spiral pattern to push washing fluid off the object as the drying fluid is directed from the drying fluid dispenser toward the object to impinge on the object in a spiral pattern such that the pattern with which the flow impinges against a surface of the object is spiral; wherein the chamber is configured to receive a dish for washing and drying of the dish in the chamber, and wherein the outlet of the drying fluid dispenser is configured to direct flow of drying fluid to impinge on a surface of the dish to push moisture on the dish toward a perimeter of the dish.

2. The apparatus of claim 1, further comprising a source of air providing an air flow as drying fluid to the drying fluid dispenser.

3. The apparatus of claim 1, further comprising a holder configured to hold a dish or other eating utensil as the object to be washed in the chamber.

4. The apparatus of claim 1, further comprising openings for placing one or more hands of a person into the chamber for washing and drying of the hands.

5. The apparatus of claim 1, further comprising a source of washing fluid for delivery to the washing fluid dispenser to wash an object in the chamber.

6. The apparatus of claim 1, further comprising a drain configured to drain liquid from the chamber and a monitor configured to examine liquid draining from the chamber to provide information indicative of the extent of cleanliness of an object being washed.

7. The apparatus of claim 1, further comprising a lift mechanism to receive an object in the chamber to lower the object into the chamber for washing and drying of the object and for lifting the object for convenient removal of the object.

8. The apparatus of claim 1, further comprising a dispenser of detergent and/or sanitizer into the chamber.

9. The apparatus of claim 1, further comprising a source of ultraviolet light providing ultraviolet light in the chamber; the chamber having at least part that is transmissive of light to permit viewing inside the chamber while an object is being washed and/or dried; and wherein that part of the chamber that is transmissive of light blocks transmission of ultraviolet light.

10. The apparatus of claim 1, further comprising controls configured to control the flow of washing fluid and drying fluid to wash and dry an object in the chamber.

11. The apparatus of claim 1, wherein the washing fluid dispenser and drying fluid dispenser are configured to wash an object in the chamber while simultaneously directing both washing fluid and drying fluid to the object during washing thereof.

12. The apparatus of claim 1, further comprising a source of infra-red energy configured to provide infra-red energy in the chamber.

13. The apparatus of claim 1, wherein the drying fluid dispenser is configured to direct a flow of drying fluid in a spiral pattern as the drying fluid is directed toward the object such that the radii of the spiral pattern varies based on the spiraling pattern motion.

14. The apparatus of claim 1, wherein the drying fluid dispenser includes an outlet that is movable to direct the flow of drying fluid toward the object while moving the flow of drying fluid in a spiral pattern as the drying fluid is directed from the drying fluid dispenser toward the object to impinge on the object in a spiral pattern.

15. A washing and drying apparatus, comprising a housing, a chamber in the housing, a washing fluid dispenser configured to direct a spray of washing fluid to an object in the chamber to wash the object, and a drying fluid dispenser configured to direct a flow of drying fluid at an object in the chamber to dry the object, wherein the drying fluid dispenser is configured to direct the flow of drying fluid that moves in a spiral pattern to impinge on the object in a spiral pattern as the drying fluid is directed toward the object such that the pattern with which the flow impinges against a surface of the object is spiral, and wherein the drying fluid dispenser comprises a pair of relatively rotatable discs, one having at least one elongate slot therethrough and the other having at least one curved slot therethrough, wherein the pair of rotatable discs are aligned in sequential flow relation to each other such that drying fluid provided to the apparatus first flows through one of the slots and subsequently flows through the other of the slots, and wherein in response to the discs rotating at different speeds of rotation the slots are configured to direct the flow of drying fluid in the chamber toward an object to be dried in a spiral pattern against a surface of such object.

16. The apparatus of claim 15, wherein one disc includes a support for at least one nozzle to spray washing fluid toward an object in the chamber, an annular recess about the disc to receive washing fluid therein from a source, and a flow path from the annular recess to the at least one nozzle.

17. The apparatus of claim 16, further comprising a source of washing fluid coupled in generally fluidically sealed relation with the annular recess, whereby, while the one disc rotates, washing fluid is supplied to the annular recess for coupling via the flow path to the at least one nozzle.

18. The apparatus of claim 15, further comprising a motor configured to rotate the discs at different respective speeds of rotation.

19. The apparatus of claim 15, wherein at least one of the at least one elongate slot through one disc is generally straight and at least one of the at least one curved slot through the other disc is generally of spiral shape.

20. The apparatus of claim 2, wherein the source of air flow is a blower.

21. A washing and drying apparatus, comprising a housing, a chamber in the housing, a washing fluid dispenser configured to direct a spray of washing fluid to an object in the chamber to wash the object, and a drying fluid dispenser configured to direct a flow of drying fluid at an object in the chamber to dry the object, wherein the drying fluid dispenser includes an outlet that undergoes spiral motion to direct the flow of drying fluid in a spiral pattern toward the object while moving the flow of drying fluid in a curve shape as the drying fluid is directed from the drying fluid dispenser toward the object to impinge on the object in a curve shape that winds around a center at an increasing or decreasing distance from the center as the drying fluid is directed toward the object to push washing fluid from the object; wherein the chamber is configured to receive a dish and/or eating utensil for washing and drying of the dish and/or eating utensil in the chamber, and wherein the outlet of the drying fluid dispenser is configured to direct flow of drying fluid to impinge on a surface of the dish and/or eating utensil to push moisture on the dish and/or eating utensil toward a perimeter of the dish and/or eating utensil.

22. The apparatus of claim 21, wherein the center is substantially fixed center point about which the curve shape winds.

23. The apparatus of claim 21, wherein the drying fluid dispenser is configured to direct a flow of drying fluid in a spiral pattern as the drying fluid is directed toward the object such that the radii of the spiral pattern varies based on the spiraling pattern motion.

24. The apparatus of claim 21, wherein the drying fluid dispenser includes an outlet that is movable to direct the flow of drying fluid toward the object while moving the flow of drying fluid in a curve shape as the drying fluid is directed from the drying fluid dispenser toward the object to impinge on the object in a curve shape that winds around a center at an increasing or decreasing distance from the center as the drying fluid is directed toward the object.

25. A washing and drying apparatus, comprising a housing, a chamber in the housing, a washing fluid dispenser configured to direct a spray of washing fluid to an object in the chamber to wash the object, and a drying fluid dispenser configured to direct a flow of drying fluid at an object in the chamber to dry the object, wherein the drying fluid dispenser includes an outlet that undergoes spiral motion to direct in a spiral pattern the flow of drying fluid as the flow flows from the fluid dispenser toward the object whereby the flow impinges against the object as the flow is moved in a spiral pattern to push washing fluid from the object; wherein the chamber is configured to receive a dish for washing and drying of the dish in the chamber, and wherein the outlet of the drying fluid dispenser is configured to direct flow of drying fluid to impinge on a surface of the dish to push moisture on the dish toward a perimeter of the dish.

26. A washing and drying apparatus, comprising a housing, a chamber in the housing, a washing fluid dispenser configured to direct a spray of washing fluid to an object in the chamber to wash the object, and a drying fluid dispenser configured to direct a flow of drying fluid at an object in the chamber to dry the object, wherein the drying fluid dispenser includes an outlet that undergoes spiral motion to direct a flow of drying fluid in a spiral pattern that is created by continuously changing the angle and distance from a central location of drying fluid flow from the drying fluid dispenser toward the object such that the drying fluid flow moves in a curved pattern to impinge on the object in a curved pattern as the drying fluid is directed toward the object such that the pattern with which the flow impinges against a surface of the object is spiral to push washing fluid from the object including from the edge of the object; wherein the chamber is configured to receive a dish for washing and drying of the dish and/or eating utensil in the chamber, and wherein the outlet of the drying fluid dispenser is configured to direct flow of drying fluid to impinge on a surface of the dish to push moisture on the dish toward a perimeter of the dish.

27. The apparatus of claim 26, wherein the curved pattern is a spiral pattern.

28. A dishwasher, comprising a housing, a chamber in the housing configured to receive a dish, a washing fluid dispenser configured to direct a spray of washing fluid to the dish in the chamber to wash the dish, and a drying fluid dispenser configured to direct a flow of drying fluid at a dish in the chamber to dry the dish, wherein the drying fluid dispenser includes an outlet that undergoes spiral motion to direct the flow of drying fluid toward the dish to push washing fluid that is on the dish toward the perimeter of the dish while moving the flow of drying fluid in a spiral pattern as the drying fluid is directed from the drying fluid dispenser toward the object to impinge on the dish in a spiral pattern such that the pattern with which the flow impinges against a surface of the dish is spiral.

29. The dishwasher of claim 28, wherein the flow of drying fluid blows washing fluid away from an edge of the dish.

30. The dishwasher of claim 28, wherein the washing fluid comprises a washing liquid and/or a rinsing liquid.

* * * * *